US011168549B2

(12) United States Patent
Ewing et al.

(10) Patent No.: US 11,168,549 B2
(45) **Date of Patent: *Nov. 9, 2021**

(54) AUTOMATED SUCKER ROD SPACING DEVICE AND ASSOCIATED METHODS

(71) Applicant: TRC Services, Inc., The Woodlands, TX (US)

(72) Inventors: Donald Ewing, Big Spring, TX (US); Michael Eric Johnson, The Woodlands, TX (US); Donald Mike Johnson, The Woodlands, TX (US); Joe Boyd, Midland, TX (US); Danny Uselton, The Woodlands, TX (US)

(73) Assignee: TRC Services, Inc., The Woodlands, TX (US)

( * ) Notice: Subject to any disclaimer, the term of this patent is extended or adjusted under 35 U.S.C. 154(b) by 2 days.

This patent is subject to a terminal disclaimer.

(21) Appl. No.: 16/716,031

(22) Filed: Dec. 16, 2019

(65) Prior Publication Data

US 2020/0182028 A1 Jun. 11, 2020

Related U.S. Application Data

(63) Continuation-in-part of application No. 15/411,220, filed on Jan. 20, 2017, now Pat. No. 10,508,522.

(60) Provisional application No. 62/286,170, filed on Jan. 22, 2016, provisional application No. 62/287,784, filed on Jan. 27, 2016, provisional application No. 62/288,913, filed on Jan. 29, 2016.

(51) Int. Cl.

| | |
|---|---|
| ***E21B 43/12*** | (2006.01) |
| ***E21B 47/009*** | (2012.01) |
| ***E21B 47/09*** | (2012.01) |

(52) U.S. Cl.
CPC ..... *E21B 43/127* (2013.01); *E21B 47/009* (2020.05)

(58) Field of Classification Search
CPC ..... E21B 43/127; E21B 47/009; E21B 47/09; E21B 43/13
See application file for complete search history.

(56) References Cited

U.S. PATENT DOCUMENTS

| | | | |
|---|---|---|---|
| 2,038,527 | A | 12/1935 | Eaton |
| 2,530,055 | A | 11/1950 | Green |
| 2,925,266 | A | 2/1960 | McAllister |

(Continued)

FOREIGN PATENT DOCUMENTS

| | | | |
|---|---|---|---|
| CN | 2871802 | Y | 2/2007 |
| RU | 2532025 | C2 | 10/2014 |

OTHER PUBLICATIONS

Pump Off Controllers and the Opportunity for Customers; Case Study New Mexico; Southwestern Public Service Corporation; Xcel Energy Corporation; May 2011.

(Continued)

*Primary Examiner* — Catherine Loikith
(74) *Attorney, Agent, or Firm* — Blank Rome LLP

(57) ABSTRACT

An automated sucker rod spacing device comprising a housing, a screw set within the housing and connected to a sucker rod string via a polished rod, a nut which is in threaded engagement with the screw, a means to transmit a rotation force to the nut, wherein the rotation of the nut can lower or raise the screw and thus lower or raise the sucker rod string. The device can be used to stop tagging, ensure full pump fillage, and avoid gas lock.

26 Claims, 14 Drawing Sheets

(56) References Cited

U.S. PATENT DOCUMENTS

| | | | |
|---|---|---|---|
| 3,320,820 | A | 5/1967 | Banks |
| 3,363,475 | A | 1/1968 | Foster et al. |
| 4,176,714 | A | 12/1979 | Case |
| 4,354,395 | A | 10/1982 | Page, Jr. |
| 4,445,674 | A | 5/1984 | Clayton, Jr. |
| 4,454,778 | A | 6/1984 | Carmen |
| 4,462,759 | A | 7/1984 | McGeehee |
| 4,604,724 | A | 8/1986 | Shaginian et al. |
| 4,631,954 | A | 12/1986 | Mills |
| 5,101,676 | A | 4/1992 | Collins |
| 5,194,859 | A | 3/1993 | Warren |
| 5,970,794 | A | 10/1999 | Yoshida |
| 6,810,953 | B2 | 11/2004 | Adoline |
| 6,857,474 | B2 | 2/2005 | Bramlett et al. |
| 8,157,537 | B2 | 4/2012 | Chavez Zapata |
| 8,950,473 | B2 | 2/2015 | Smith |
| 10,385,663 | B2 * | 8/2019 | Lane ..... F04B 47/026 |
| 10,508,522 | B2 * | 12/2019 | Johnson ..... E21B 43/127 |
| 2005/0178540 | A1 | 8/2005 | Siewert |
| 2008/0314581 | A1 | 12/2008 | Brown |
| 2009/0055029 | A1 | 2/2009 | Roberson et al. |
| 2014/0367514 | A1 | 12/2014 | Fradet |
| 2015/0000930 | A1 | 1/2015 | Haarstad et al. |
| 2015/0028504 | A1 | 10/2015 | Dancek |

OTHER PUBLICATIONS

Pump-Off Control (POC); http://home.myfielddata.com/Support/UserHelp/purnp_off_controLhtml obtained Aug. 13, 2015.

Ray, Louis; Value of Rod Pump Control; eProduct ion Solutions, Inc., T\NP-003 Rev. 0.

International Search Report and Written Opinion dated Jun. 8, 2017, in International Application No. PCT/US17/14309.

* cited by examiner

AUTOMATED SUCKER ROD SPACING DEVICE AND ASSOCIATED METHODS

This application is a continuation-in-part of U.S. application Ser. No. 15/411,220, filed 20 Jan. 2017, which claims priority to U.S. Provisional Patent Application Ser. No. 62/286,170, filed on Jan. 22, 2016; Ser. No. 62/287,784, filed on Jan. 27, 2016; and Ser. No. 62/288,913, filed on Jan. 29, 2016, which are incorporated herein by reference in their entireties.

FIELD OF THE DISCLOSURE

The disclosure relates generally to the pumping of an oil well. The disclosure relates specifically to devices for adjusting the depth of a plunger on a sucker rod string in a downhole pump.

BACKGROUND OF THE DISCLOSURE

A pump jack system, which is known by several different names (beam pumping, pumping units, rocking horse, oil jack, jack pump, and many others) are above ground units that are used to drive fora reciprocating piston pump in an oil well that is located downhole in the bore of a subterranean formation. The pumping action is used to mechanically lift well bore fluids from the well bore to the surface. The pumping unit operates electrically, whether through standard power or gas generated powered prime mover which turns the crank and moves the pitman arms in a pivoting vertical motion. This motion moves the walking beam in proportion to the amount of adjustable movement of the pitman arms.

The horsehead attaches to the walking beam over the well head. Suspended from the horsehead is the bridle. The polish rod has a polish rod clamp attached to it that holds the position of the rod string. The clamps sit on top of the carrier bar. The polish rod goes through the stuffing box and is attached to the rest of the subsurface rod string which is attached to the downhole pump. This positioning of the parts allows the mechanical vertical movement of the pumping unit to be transferred to the rod string and to the down pumping system. The process of creating the downhole motion of the pumping system can also be created by the use of a vertically mounted hydraulic pumping system. The hydraulic system, though different on the surface, creates the same motion to the downhole system.

The bottom of the well may be a considerable distance from the surface, necessitating the use of a string of sucker rods. The string length/stretch typically changes due to the level of fluid in the well, i.e., the buoyancy effect on the rods. In the course of each day, continually changing conditions affect the overall length of the string of sucker rods, causing the string to increase or decrease in the length. The change in the length is not entirely predictable. The sucker rods also tend to stretch under operating loads over long periods. Other considerations are that the required adjustment range increases with well depth.

In order to ensure full pump fillage and improve production efficiency, the pump preferably stays in the same position in relation to the valve clearance. The pump's plunger should be as close to the bottom of the pump as possible to ensure maximum pump fillage. The pump should be present as close to the bottom of the well as possible, which may result in the coupling that attaches the pull rod of the pump to the rod string contacting the top of the pump during the downstroke.

This contact of the coupling and the top of the pump is known in the industry as tagging. This action of tagging causes many destructive effects. It increases the stress on the entire sucker rod string. It also causes the sucker rods to buckle and slap the inside of the tubing, which causes increased wear to the sucker rods and the tubing, and begins to start the fatigue process on the rod string. Therefore, a compensating adjustment is needed from time to time.

The pump used in connection with the sucker rods can undergo "gas lock". "Gas lock" occurs when gas enters the area below the plunger when the plunger is at the uppermost position of travel and while traveling to its lowermost position, cannot compress the gas sufficiently to force the traveling valve open. On the following upstroke, the gas expands and keeps the pressure high enough below the plunger so that the standing valve will not open and allow fluid to enter the pump.

This compressing and expanding of gas repeats itself on each downstroke and upstroke without increasing pressure enough to open the traveling valve or decreasing pressure enough to allow the standing valve to open and allow fluid to enter the pump. The simple solution to this problem is to periodically adjust the stroking depth of the plunger in the pump by adjusting the rod string. The "lowering" of the rod string can create enough pressure inside the pump to force the valve to open. The lowering of the rod string can also be moved enough so that the coupling on the pull rod strikes the top of the pump. This causes vibration in the pump and may shake the traveling valve to allow the gas to escape into the tubing to reduce the "gas lock" condition.

To avoid damage to sucker rods and lost production, the depth of the sucker rod string in the well should be controlled by lowering or raising the sucker rod string to either stop gas lock or to prevent tagging. Tagging is prevented while at the same time maximum pump fillage is ensured because the plunger is fully engaged. There have been efforts to address this task, one approach outlined by Norman (U.S. Pat. No. 5,101,676) is to provide a sucker rod depth adjusting attachment which comprises a cross bar and supporting underslung solid piston rams on each side thereof. The upper piston ends of these rams abut a depth adjusting bar, which is adjustably positioned above the cross bar by extension or retraction of the ram.

There are currently only manual solutions for spacing the sucker rod string, i.e., lowering or raising the sucker rod string. The existing manual devices to space the sucker rod string are tedious and require someone to be onsite to make the adjustments. The manual devices are not designed to constantly monitor the position of the plunger and to make automatic adjustments to ensure complete pump fillage without tagging. In addition, by the time someone realizes that a sucker rod string is tagging and makes the adjustment, the damage to the equipment has likely already occurred.

There exists a need for a device to monitor and adjust the depth of a sucker rod string automatically.

SUMMARY OF THE DISCLOSURE

An embodiment of the disclosure is a device capable of automatically controlling the depth of the sucker rod string in a well by automatically lowering or raising the sucker rod string in reaction to certain measurements, wherein the device is above ground and is operationally connected to a string of sucker rods. In an embodiment, the device is operationally connected to a string of sucker rods by one selected from the group consisting of a polished rod and a sucker rod. In an embodiment, the device further comprises a sensor in a wellbore capable of communicating with a portion of the device located above ground.

In an embodiment, the sensor is selected from the group consisting of load cells, motor sensors, pressure transducers, relays, accelerometers, and motor sensors. In an embodiment, the method of lowering or raising the sucker rod string is mechanical.

In an embodiment, the mechanical method is selected from the group consisting of hydraulics, air pistons, and spooling of the bridle.

In an embodiment, the device further comprises: a housing; a screw set within the housing and connected to a sucker rod string via a polished rod; a nut which is in threaded engagement with the screw; a means to transmit a rotation force to the nut; wherein the rotation of the nut can lower or raise the screw and thus lower or raise the sucker rod string. In an embodiment, the screw comprises a central axial bore; and a load support plate mounted on top of the screw, wherein the load support plate comprises a hole; wherein the polished rod extends up through the central axial bore and the hole of the load support plate; and wherein the polish rod is secured to the screw by a clamp positioned at the top of the load support plate. In an embodiment, the polished rod is attached to the lower end of the screw.

In an embodiment, the means to transmit consists of one selected from the group consisting of a prime mover and a transmission mechanism. In an embodiment, the prime mover is selected from the group consisting an electric motor, a hydraulic motor, and an air cylinder. In an embodiment, the transmission mechanism is selected from the group consisting of a chain and a timing belt.

In an embodiment, the device further comprises an automatic control system used to monitor and control the depth of the sucker rod string; wherein the automatic control system comprises a sensor to measure the operation of the sucker rod string and a computer to control the depth of the sucker rod string. In an embodiment, the sensor is selected from the group consisting of an accelerometer, a strain gauge, and a load cell.

In an embodiment, the sensor receives and analyzes a signal to determine if a pump is tagging; wherein if the pump is tagging, the computer raises the sucker rod string to a level where there is not tagging. In an embodiment, the automatic control system periodically lowers the sucker rod string until a tag is detected and raises the sucker rod string to ensure a plunger of a pump is close to a bottom of a well. In an embodiment, the automatic control system periodically adjusts the depth of the sucker rod string to bump the bottom of the well to avoid gas lock. In an embodiment, the automatic control system communicates with the sensor over a communications network. In an embodiment, the communications network is selected from the group consisting of a Bluetooth integration and a SCADA compatible system.

An embodiment of the disclosure is an automated sucker rod spacing device comprising: a housing having a hole through which to couple a polished rod connected to a sucker rod string; a gate through which the polished rod is inserted; two screws set within the housing, each of which having a screw ear that attaches to a bridle on a horse head; two nuts which are in threaded engagement with the screws; a means to transmit a rotation force to the two nuts; wherein the rotation of the two nuts can lower or raise the two screws and thus lower or raise the sucker rod string. In an embodiment, the means to transmit consists of one selected from the group consisting of a prime mover and a transmission mechanism. In an embodiment, the prime mover is selected from one of the group consisting of an electric motor, a hydraulic motor, and an air cylinder. In an embodiment, the electric motor can be controlled by a variable frequency drive. In an embodiment, the transmission mechanism is selected from the group consisting of a chain and a timing belt.

An embodiment of the disclosure is a method of automatically controlling the depth of the sucker rod string in the well comprising utilizing the device. In an embodiment, the method further comprises logging data into reports. In an embodiment, the data is at least one selected from the group consisting of an initial position of the sucker rod string, a number of adjustments of the depth of a sucker rod string; a direction of each adjustment, a distance of each adjustment, a position of the sucker rod string being in adjustment, a last surface diagnostic card, and a last down hole diagnostic card.

In an embodiment, the method further comprises interfacing the device with a pumping unit or a pump off controller to shut down the well when there is not enough fluid to pump. In an embodiment, the method further comprises utilizing a user interface to enter a production rod string and a pump to calculate an approximate production during a set time period. In an embodiment, the method further comprises shutting down a pump if one or more operating parameters are not met for a programmable period of time. In an embodiment, the method further comprises drawing a surface card and a downhole card; and identifying common cards to identify possible issues. In an embodiment, the method is integrated into a diagnostic software to export data and produce problem notification. In an embodiment, the method further comprises monitoring equipment; and producing logs, reports, and notification from a remote location.

In an embodiment, the method further comprises utilizing an artificial intelligence system that can dynamically keep track of various parameters of the device, provide early indications of failures, and provide suggestions on types of maintenance work required. In an embodiment, the artificial intelligence system collects data from a pump off controller. In an embodiment, the data is at least one selected from the group consisting of card area, peak surface load, minimum surface load, strokes per minute, surface stroke length, flow line pressure, pump fillage, yesterday cycles, and daily run time.

The foregoing has outlined rather broadly the features of the present disclosure in order that the detailed description that follows may be better understood. Additional features and advantages of the disclosure will be described hereinafter, which form the subject of the claims.

BRIEF DESCRIPTION OF THE DRAWINGS

In order that the manner in which the above-recited and other enhancements and objects of the disclosure are obtained, a more particular description of the disclosure briefly described above will be rendered by reference to specific embodiments thereof which are illustrated in the appended drawings. Understanding that these drawings depict only typical embodiments of the disclosure and are therefore not to be considered limiting of its scope, the disclosure will be described with additional specificity and detail through the use of the accompanying drawings in which.

DETAILED DESCRIPTION

The particulars shown herein are by way of example and for purposes of illustrative discussion of the preferred embodiments of the present disclosure only and are presented in the cause of providing what is believed to be the most useful and readily understood description of the principles and conceptual aspects of various embodiments of the disclosure. In this regard, no attempt is made to show structural details of the disclosure in more detail than is necessary for the fundamental understanding of the disclosure, the description taken with the drawings making apparent to those skilled in the art how the several forms of the disclosure may be embodied in practice.

The following definitions and explanations are meant and intended to be controlling in any future construction unless clearly and unambiguously modified in the following examples or when application of the meaning renders any construction meaningless or essentially meaningless. In cases where the construction of the term would render it meaningless or essentially meaningless, the definition should be taken from Webster's Dictionary 3rd Edition.

As used herein, the term "polished rod" refers to a piston that passes through a stuffing box at a wellhead.

The term "pump-off controller" refers to equipment that monitors pump conditions and based upon preset conditions, shuts down the pump unit for a preset period of time to allow entry of fluid into the well bore to optimize performance.

The term "pump fillage" refers to the quantity of fluid entering the pump on each stroke.

Figure 1:
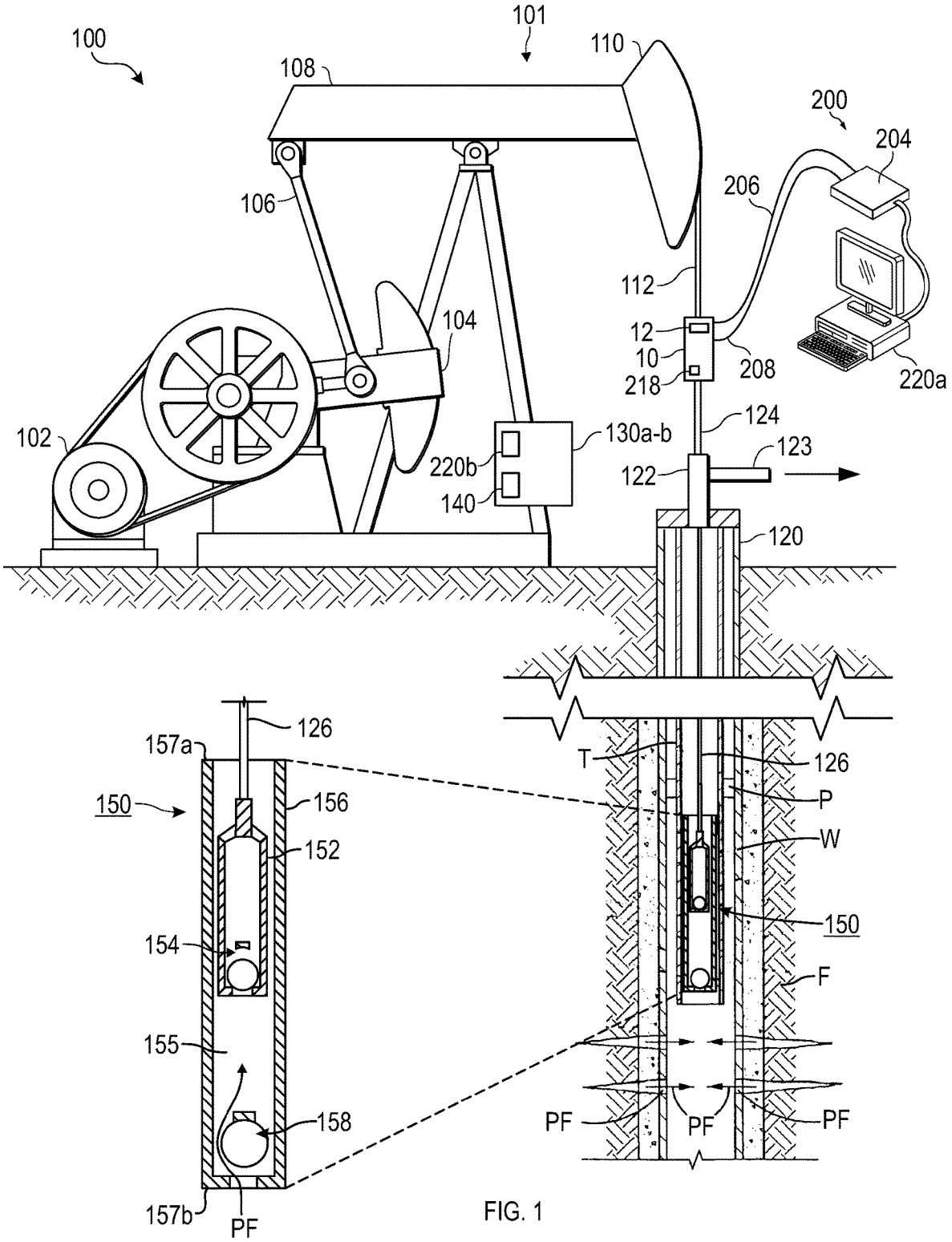
FIG. 1 illustrates a reciprocating rod lift system having an automated rod spacing device and control system of the present disclosure.

A reciprocating rod lift system 100 according to the present disclosure is shown in FIG. 1 to produce production fluid PF from a wellbore W. Surface casing hangs from the surface and can have a liner casing hung therefrom by a liner hanger (not shown). Production fluid PF from the formation F can enter the cemented casing through perforations. To convey the fluid, production tubing T extends from a wellhead 120 downhole, and a packer P seals the annulus between the production tubing T and the casing. At the surface, the wellhead 120 receives production fluid and diverts it to a flow line 123.

The production fluid PF may not naturally reach the surface so operators use the reciprocating rod lift system 100 to lift the fluid PF. The system 100 has a surface pumping unit 101, a rod string 126, and a downhole rod pump 150. Reciprocal movement of the rod string 126 by the surface pumping unit 101 induces reciprocal movement in the downhole pump 150 for lifting the production fluid PF to the surface. For example, as the surface pumping unit 101 reciprocates the rod string 126, the reciprocating rod string 126 operates the downhole rod pump 150. The rod pump 150 has internal components attached to the rod string 126 and has external components positioned in a pump-seating nipple, which may or may not be close to the producing zone and the perforations. As just one example, some wells can have perforations defined from 3,000-10,000 ft and may have the pump set at about 8,000 ft.

As shown in the detail of FIG. 1, the downhole pump 150 has a barrel 156 with a plunger 152 movably disposed therein. The barrel 156 has a standing valve 158, and the plunger 152 is attached to the rod string 126 and has a traveling valve 154. For example, the traveling valve 154 is a check valve (i.e., one-way valve), which can have a ball and seat. For its part, the standing 158 disposed in the barrel 156 is also a check valve, which can have a ball and seat.

As the surface pumping unit 101 in FIG. 1 reciprocates, the rod string 126 reciprocates in the production tubing T and moves the plunger 152 in the barrel 156. The plunger 152 moves the traveling valve 154 in reciprocating upstrokes and downstroke. During an upstroke, the traveling valve 154 as shown in FIG. 1 is closed (La, the upper ball seats on upper seat). Movement of the closed traveling valve 154 upward reduces the static pressure within a pump chamber 155 (the volume between the standing valve 158 and the traveling valve 154 that serves as a path of fluid transfer during the pumping operation). This, in turn, causes the standing valve 158 to unseat so that the lower ball lifts off the lower seat. Production fluid PF is then drawn upward into the pump chamber 155.

On the following downstroke, the standing valve 158 closes as the standing ball seats upon the lower seat. At the same time, the traveling valve 154 opens so fluids previously residing in the pump chamber 155 can pass through the valve 154 and into the plunger 152. Ultimately, the produced fluid PF is delivered by positive displacement of the plunger 152, out the passages at the top 157*a* of the barrel 156. The moved fluid then moves up the wellbore W through the tubing T as shown in FIG. 1. The upstroke and down stroke cycles are repeated, causing fluids to be lifted upward through the tubing T and ultimately to the wellhead 120 at the earth's surface.

As shown in FIG. 1, the surface pumping unit 101, which is known by several different names (beam pumping, pumping unit, rocking horse, oil jack, pump jack, and many others), is an above ground unit that is used to drive the downhole pump 150. Although a pump jack 101 is shown, other sucker-rod pump systems can be used, such as a strap jack, or any other system that reciprocates a rod string using cables, belts, chains, and hydraulic, pneumatic, or electric power systems.

The pumping unit 101 has an automated spacing device 10 and an automated control system 200 for operating the rod lift system 100. The spacing device 10 can adjust the spacing of the rod string 126 relative to the pumping unit 101, which can thereby adjust the depth of the plunger 152 in the barrel 156 of the downhole pump 150. The control system 200 can be an independent controller for operating the spacing device 10. Alternatively, in addition to operating the spacing device 10, the control system 200 can include features of a pump-off controller 130*a* or a variable drive controller 130*b* as disclosed herein for controlling pumping action of the surface pumping unit 101. In turn, the pumping action is used to mechanically lift wellbore production fluids PF from the wellbore W to the surface.

For example, operated by the control system 200, the pumping unit 101 operates electrically, whether through standard power or a gas generated powered prime mover or motor 102 that turns a crank 104 and moves pitman arms 106 in a pivoting vertical motion. This motion moves a walking beam 108 in proportion to the amount of adjustable movement of the pitman arms 106. A horsehead 110 attaches to the walking beam 108 over the wellhead 120, and bridle 112 is suspended from the horsehead 110.

A polish rod 124 has a polish rod clamp (not shown) attached to it that holds the position of the rod string 126. The clamp can sit on top of a carrier bar. The polish rod 124 goes through a stuffing box 122 and is attached to the rest of the subsurface rod string 126, which is attached downhole to the plunger 152 of the downhole pump 150. This positioning of the parts allows the mechanical movement of the pumping unit 101 to be transferred to the rod string 126 and to the downhole pump 150. (The process of creating the downhole motion of the downhole pump 150 can also be created by the use of a vertically mounted hydraulic pumping system (not shown). The hydraulic system, though different on the surface, creates the same motion to the downhole pump 150.)

As will be appreciated, the bottom of the well W may be a considerable distance from the surface, necessitating the use of the rod string 126, which typical has a plurality of interconnected sucker rods. The string length/stretch typically changes due to the level of fluid in the well W, i.e., the buoyancy effect on the rods 126. In the course of each day, continually changing conditions affect the overall length of the string 126 of sucker rods, causing the string 126 to increase or decrease in the length. The change in the length is not entirely predictable. The sucker rod string 126 also tends to stretch under operating loads over long periods. Other considerations are that the required adjustment range increases with well depth.

In order to ensure full pump fillage and improve production efficiency, the pump's plunger 152 is preferably as close to the bottom 157*b* of the pump's barrel 156 as possible to ensure maximum pump fillage. Changes in the length of the rod string 126, however, may result in a coupling that attaches a pull rod to the pump plunger 152 contacting the top 157*a* of the pump's barrel 156 during the downstroke or may result in the bottom of the plunger 152 impacting toward the bottom of the barrel 156.

This contact of the plunger 152 and the pump's barrel 156 is known in the industry as tagging. This action of tagging causes many destructive effects. It can increase the stress on the entire sucker rod string 126, can cause the string 126 to undergo compression, and can cause the rod string 126 to buckle and slap the inside of the tubing T. These destructive effects cause increased wear to the sucker rods and the tubing T, and begins to start the fatigue process on the rod string 126. Therefore, a compensating adjustment is needed from time to time.

During operation, the pump 150 can also undergo "gas lock." In general, "gas lock" occurs when gas enters the pump chamber 155 below the plunger 152 when the plunger 152 is at the uppermost position of travel in the barrel 156. While the plunger 152 is traveling to its lowermost position in the barrel 156, the plunger 152 cannot compress the gas sufficiently to force the traveling valve 154 open. On the following upstroke, the gas expands in the pump chamber 155 and keeps the pressure high enough below the plunger 152 so that the standing valve 158 will not open and allow fluid to enter the pump barrel 156.

This compressing and expanding of gas in the pump chamber 155 repeats itself on each downstroke and upstroke without increasing pressure enough to open the traveling valve 154 or decreasing pressure enough to allow the standing valve 158 to open and allow fluid to enter the pump 150. The simple solution to this problem is to periodically adjust the stroking depth of the plunger 152 in the pump's barrel 156 by adjusting the rod string 126.

In particular, the "lowering" of the rod string 126 by the automated control system 200 and spacing device 10 can create enough pressure inside the pump 150 to force the valves 154, 158 to open. The lowering of the rod string 126 can also be moved enough so that the coupling on the pull rod strikes the top of the pump 150 and/or the bottom of the plunger 152 strikes near the bottom of the barrel 156. This causes vibration in the pump 150 and may shake the traveling valve 154 to allow the gas to escape into the tubing T to reduce the "gas lock" condition.

Accordingly, operation of the control system 200 and spacing device 10 seeks to avoid damage to sucker rods 126 and lost production. The depth of the sucker rod string 126 in the well W is controlled with the control system 200 by lowering or raising the sucker rod string 126 with the spacing device 10 to either stop gas lock or to prevent tagging. Tagging is prevented while at the same time maximum pump fillage can be attained because the plunger 152 is fully engaged.

To automatically control the depth of the sucker rod string 126 in the well W and by extension to set the upper and lower positions of the plunger 152 in the barrel 156, the reciprocating rod lift system 100 includes the spacing device 10 connected between the surface pumping unit 101 and the rod string 126. The spacing device 10 is used in conjunction with the automated control system 200. The control system 200 monitors (and can further control) the pumping operation, and the spacing device 10 automatically adjusts the depth of the plunger 152 on the sucker rod string 126.

As briefly shown in FIG. 1, the automated control system 200 includes a control unit 220*a-b* used with the spacing device 10, which has an actuator 12. The control unit 220*a-b* is configured to monitor reciprocation of the sucker rod string 126 and/or the surface pumping unit 101 and is configured to determine an adjustment of a depth for the plunger 152 in the barrel 156 based on the monitored reciprocation.

Figure 2A:
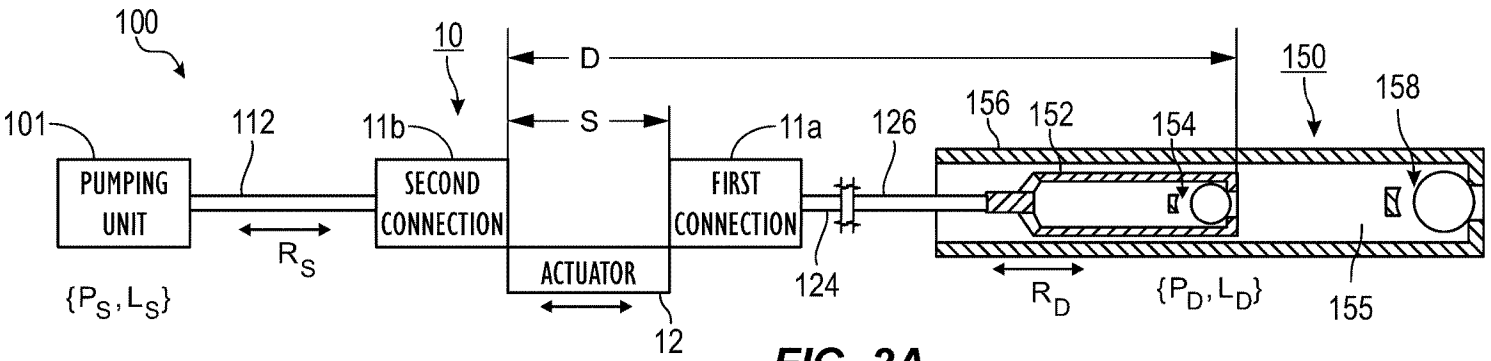
FIG. 2A is a schematic view of components for the reciprocating rod lift system.

For its part and as schematically shown in FIG. 2A, the surface pumping unit 101 reciprocates at surface ($R_S$) with surface position ($P_S$) and load ($L_S$) that is transferred through the bridle 112, spacing device 10, polished rod 124, rod string 126, and the like to the plunger 152 of the downhole pump 150. The plunger 152 reciprocates downhole ($R_D$) with downhole position ($P_D$) and load ($L_D$), which is different than that at surface due to dynamic effects.

The spacing device 10 has a first connection 11*a* to the rod string 126 and has a second connection 11*b* to the surface pumping unit 101. For example, the first connection 11*a* to the rod string 126 can be via the polished rod 124, rod clamp, and the like, while the second connection 11*b* to the pumping unit 101 can be via the bridle 112, carrier bar, and the like. The spacing device 10 has an adjustable spacing S between these first and second connections 11*a-b*. The actuator 12 is configured to adjust the adjustable spacing S between the first and second connections 11*a-b* of the device 10 in response to the control system's determined adjustment. Adjustment of the spacing S thereby raises or lowers the depth D of the plunger 152 in the barrel 156, which is fixed downhole in the well. This change in depth D can counter or adjust for changes in length of the sucker rod string 126 due to dynamic effects.

Overall, the control unit 220*a-b* of FIG. 1 can be integrated with, can be part of, can be used in communication with, can be connected to, or can include a controller 130*a-b* of the surface pumping unit 101 configured to control the operation of the surface pumping unit 101. As noted below, the control unit can include an independent control unit 220*a* separate from the pump controller 130*a-b* or can include an integrated control unit 220*b* with the pump controller 130*a-b*. As noted below, the pump controller can be a pump-off controller 130*a* or can be a variable drive controller 130*b*.

As noted below, sensing equipment can be disposed on the surface pumping unit 101 and can measure position, load, and other measurements at the surface pumping unit 101. For example, the sensing equipment can include one or more of an accelerometer, a proximity sensor, a position sensor, a strain gauge, and a load cell.

As also noted below, a variable frequency drive 140 can be used with the surface pumping unit 101 and can be operable to set a speed to drive the surface pumping unit 101. The control unit 220*a-b* can be configured to determine the adjustment of the depth for the plunger 152 in the barrel 156 in conjunction with being configured to determine the speed to set for the variable frequency drive 140. In addition or in the alternative, the control unit 220*a-b* can obtain a set speed for the variable frequency drive 140 and can be configured to determine a requisite adjustment of the depth for the plunger 152 in the barrel 156 based at least on the set speed.

As noted above, one embodiment of the automated control system 200 includes an independent control unit 220*a*, which can be a computer, a programmable logic controller, an integrated machine controller, or the like. The independent control unit 220*a* can be disposed on the spacing device 10, can be mounted independently at the wellsite, or can be at a remote location in communication with the wellsite.

As shown in FIG. 1, an accelerometer 218 is mounted on the polished rod 124. For example, the accelerometer 218 can be part of the spacing device 10. The accelerometer 218 can be connected through an electrical cable 206 to an electronics package 204. The output from the electronics package 204 can be connected through a ribbon cable to the independent control unit 220*a*, and the instructions from the independent control unit 220*a* can be communicated through a command cable 208 for sending control signals to the actuator 12 of the sucker rod spacing device 10.

As will be appreciated, the cables 206, 208 connecting the device 10 to the separate control unit 220*a* can become damaged. In particular, the cables 206, 208 connected between the device 10 and the accelerometer 218 moves with the polished rod 124 and may be prone to damage. In an alternate embodiment, wireless communications can be used to transmit measurements and commands rather than communications through cables 206, 208. The components of the control system 200 can therefore be configured to send and receive wireless signal.

The communication protocol used for these wireless communications is, for example, LIN (Local Interconnect Network) or other relatively low speed communication protocol. However, high speed communication protocol such as CAN (Controller Area Network) can also be used. The advantage of wireless communication includes no need for physical cables, less malfunctions, easy maintenance, and convenience of repair.

As noted above, another embodiment of the automated control system 200 includes an integrated control unit 220*b*, which can be a computer, a programmable logic controller, an integrated machine controller, or the like. This integrated control unit 220*b* can be integrated with, part of, in communication with, connected to, or include a pump controller 130*a-b* configured to control the operation of the surface pumping unit 101. As discussed below, such a pump controller can include a pump-off controller 130*a* or a variable speed drive controller 130*b*.

As before, the accelerometer 218 can be mounted on the polished rod 124, such as being disposed as part of the device 10, and the accelerometer 218 can be connected through wired or wireless communications with a processing unit of the integrated control unit 220*b*. In addition or in the alternative, the integrated control unit 220*b* can communicate with other sensing equipment (e.g., load cell, position sensor, proximity sensor, strain gauge, etc.) disposed on the surface pumping unit 101 to monitor the operation and automatically control the depth of the sucker rod string 126 in the well W accordingly.

Figure 2B:
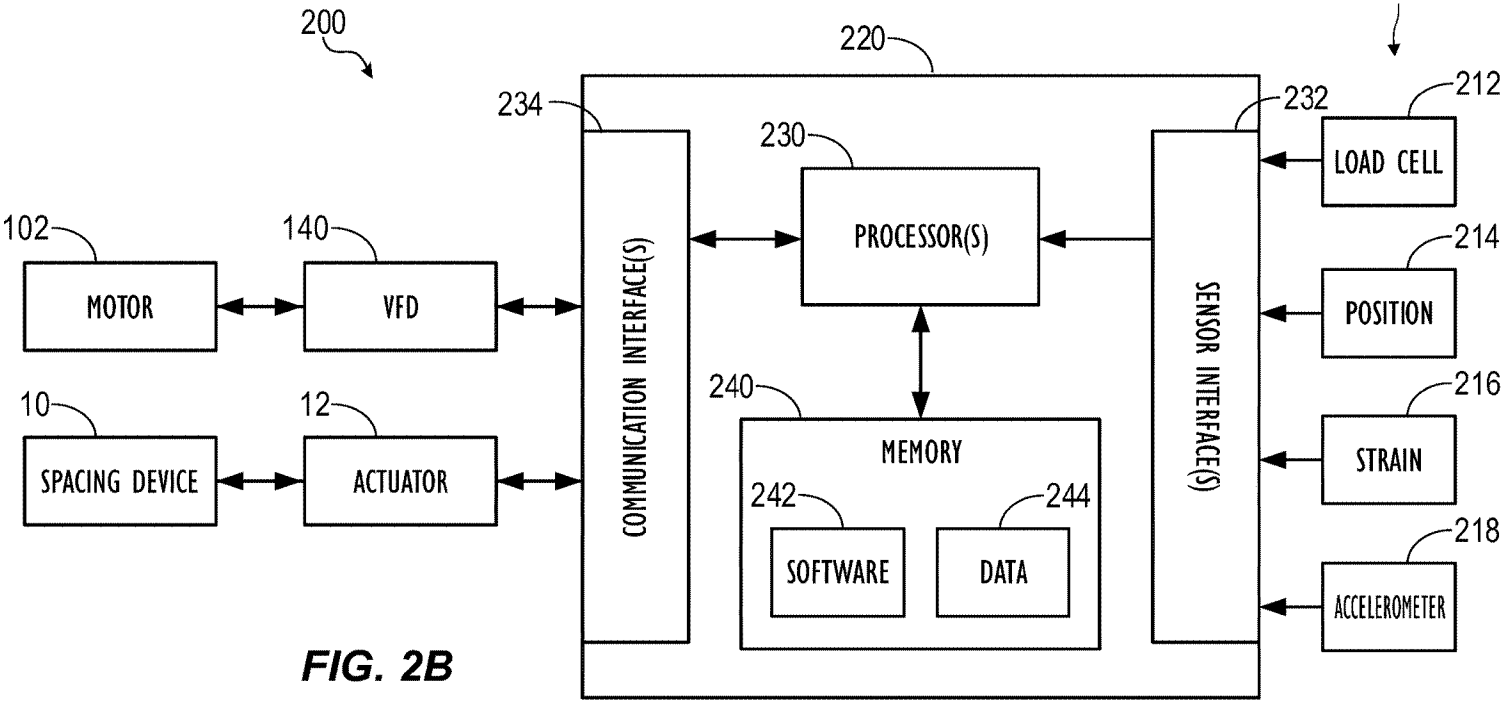
FIG. 2B is a schematic view of components for the automated spacing device and control system.

For example, FIG. 2B shows details of the automated control system 200 for the reciprocating rod lift system (100; FIG. 1). In general, sensing equipment 210 measures one or more of load, position, strain, acceleration, and other data of the reciprocating rod lift system (100) and its components at the surface, and the measured data from the sensing equipment 210 is relayed to a control unit 220 to monitor operation of the reciprocating rod lift system (100). For example, the sensing equipment 210 can use a load sensor 212 to detect the lifting load, which includes the weight of the fluid and the portion of the rod string that is not buoyant, during operation of the reciprocating rod lift system 100. The load data can be directly measured using a load cell inserted between a polished rod clamp and a carrier bar (or more particularly a portion of the spacing device 10) on the pumping unit 101. The strain on the walking beam 108 measured by a strain sensor 216 can also provide the load data.

The sensing equipment 210 can include a position sensor 214 to measure the position of at least a portion of the reciprocating rod lift system (100) over each cycle of stroke. The position can then be used to determine displacement data for the stroke. For example, a proximity sensor can be used to measure the crank arms (104) of the pumping unit (101). An accelerometer 218 can be used to measure acceleration of at least a portion of the pumping unit 101 during operation to determine displacement data. For example, the accelerometer 218 can measure the acceleration/deceleration of the polished rod (124) at the spacing device (10). Overall, the accelerometer data can be used to calculate the same data as a crank arm sensor, but in a more detailed fashion.

The control unit 220 can also use motor sensors (not shown) to measure the amplitude and frequency of electrical power applied to the surface pumping unit's motor 102. These motor sensors can determine revolutions of the motor (i.e. amplitude and frequency of the motor for calculating displacement data) and motor torque (i.e. for calculating load data), which can then be converted to values for load on the rod string 126 and displacement of the rod string 126.

In general, the control unit 220 can be the independent control unit (220*a*) or the integrated control unit (220*b*) as described above with respect to FIG. 1. The control unit 220 includes sensor interfaces 232 receiving measurements from the sensing equipment 210. The control unit 220 can have software 242 and data 244 stored in memory 240. The software 242 can include motor control software and pump diagnostic software, and the data 244 stored can include the measurements logged from the various sensors of the sensing equipment 210 and calculation results. The data 244 in the memory 240 can also store characteristics of the well, including the depth, azimuth, and inclination of points along the well, which can be derived from drilling and survey data. For many wells, the pump-off controller in the field only holds set points for the rod string and process parameters and does not have information about deviation surveys. The data 244 in the memory 240 can also store characteristics of the sucker rod taper, such as depth, diameter, weight, and length of various sections of the rod in the rod string 126. The weight can be calculated using a data table.

A processing unit 230 of the control unit 220 has one or more processors. The processing unit 230 processes the measurements by storing the measurement as data 244 in the memory 240 and by running the software 242 to make various calculations as detailed herein. For example, the processing unit 230 obtains outputs from the surface sensors, such as the load and position measurements from the sensing equipment 210. In turn, the processing unit 230 correlates the output from the load sensor 212 to the position of the polished rod (124) and determines the load experienced by the polished rod (124) during the stroke cycles. Using the software 242 and this surface data, the processing unit 230 then calculates a downhole card indicative of the load and position at the downhole pump (150). This processing can be done in either form of the pump-off or variable drive controller according to the present disclosure.

Using known algorithms and equations, for example, the control unit 220 can calculate pump fillage and optimize production on each stroke. This information is used to minimize fluid pounding by stopping or slowing down the pumping unit (101) at the assigned pump fillage setting. Because the shape, pattern, and other features associated with the downhole pump card represents various conditions of the pump (150) and its operation as discussed below with reference to FIG. 3, the control unit 220 can also analyze the downhole pump card. In turn, the control unit 220 can determine potential problems associated with the pump (150) and its operation, and the control unit 220 can calculate results/adjustment and make changes to the operation.

Based on the measurements and the processing, the control unit 220 can send signals to the motor (102) to operate the pumping unit (101), which may or may not include a variable frequency drive 140. For example, one or more communication interfaces 234 communicate with the motor 102 to control operation of the pumping unit (101) by shutting off the motor 102 to prevent pump-off, etc. or by adjusting the variable frequency drive 140 of the motor 102.

The control unit 220 can also send signals to the actuator 12 of the spacing device 10 according to the techniques disclosed herein. For example, one or more communication interfaces 234 communicate with the actuator 12 to control operation of the spacing device 10 to adjust the internal spacing of the device 10 and thereby change the depth of the plunger 152 in the downhole pump (150).

As noted above, the automatic spacing device 10 can operate on a conventional pumping unit 101 having a standard pump-off controller 130*a*. In this case, the device 10 can include the independent control unit 220*a* that performs the techniques disclosed herein. Alternatively, the automatic spacing device 10 can include an integrated control unit 220*b* that is integrated with, part of, etc. the controller 130*a-b* of the surface pumping unit 101. Either way, the control unit 220*a-b* can be integrated with the monitoring equipment at the pumping unit 101. By the results gained from processing parameters, the automated control system 200 adjusts the spacing clearance in the downhole pump 150 to increase efficiencies. Accordingly, the automated control system 200 is not limited to use with a standard pump-off controller 130*a*. Through the data collection and the analytics, the automated control system 200 works with a variable speed controller 130*b*.

In the control system 200 and spacing device 10 of FIGS. 1 and 2A-2B, the accelerometer 218 moves up and down with the polished rod 124 and generates a varying signal depending on the state of acceleration it experiences. This signal can be provided through the communication to the control unit 220*a-b*, which can then do real-time modeling of what is happening with the sucker rod string 126 and the pump 150 downhole. Based on different events encountered, the control unit 220*a-b* sends commands to the actuator 12 in sucker rod spacing device 10. The actuator 12 can drive an adjustable spacing (e.g., a screw and nut arrangement) in the spacing device 10 to raise or lower, thus to shorten or lengthen the overall string 126 and adjust the depth of the plunger 152 inside the barrel 156 whatever amount is required for optimal production. The control unit 220*a-b* monitors the strings' status in real-time and is capable of making multiple unattended adjustments within minutes.

In an embodiment, the automatic control system 200 can be used to receive and analyze a signal to determine if the sucker rod string 126 is "tagging" (e.g., if the pump plunger 152 is hitting the barrel 156). The control system 200 analyses the data from the accelerometer 218. When there is a sudden change of the acceleration of the accelerometer 218, the control system 200 determines the pump 150 is "tagging," and sends commands to the actuator 12 to raise the rod string 126 to a level that stops the "tagging."

It should be appreciated that the accelerometer 218 used here is only exemplary and that other means that are capable of sending a signal which is capable of being analyzed to determine if the pump plunger 152 is "tagging" to the control system 200. For example, a signal from a load cell (not shown), other sensor, pump-off controller 130*a*, or variable drive controller 130*b* can be used.

In another embodiment, the automatic control system 200 can be used to periodically lower the rod string 126 automatically to ensure that there is not too much spacing in the downhole pump 150, ensuring full pump fillage. In this situation, the automatic control system 200 can lower the rod string 126 until it analyzes a slight tag. Then, the control system 200 can slightly raise the rod string 126 to ensure the plunger 152 is close to the bottom of the barrel 156 without tagging.

In wells with fiberglass rods installed, the automatic control system 200 can have additional benefits. Fiberglass sucker rods tend to stretch significantly more than steel sucker rods, and they are incapable of handling repeated compressive loads. Due to the stretch of the rods and the inability to handle compression, oil well operators typically install the sucker rod string 126 further off bottom than is necessary to ensure they never go into compression. This extra space reduces the amount of production from the oil well, and allows more gas to enter the pump 150, further reducing production and causing damage to the sucker rod string 126, the downhole pump 150, and tubing. Moreover, the amount of stretch in the fiberglass rods 126 is constantly changing with the fluid level in the well. As a result, the automatic control system 200 can be ideal for fiberglass sucker rod strings 126 to ensure the plunger 152 is close to the bottom of the pump 150 without tagging.

In an embodiment, the automatic control system 200 can be used to avoid gas lock. In this case, the automatic control system 200 can periodically adjust the depth of the rod string 126 to slightly tag the pump 150 (e.g., bump the plunger 152 in the pump 150 to allow the plunger 152 to come as close to the standing valve 158 as possible) so as to shake any gas bubbles loose.

In an embodiment, the automatic control system 200 operates according to a method that includes logging data (244) for processing and reporting. The data may include the initial position of the sucker rod string 126, the number of adjustments of the depth of the sucker rod string 126, the direction of each adjustment that represents raising or lowering the sucker rod string 126, and the distance of each adjustment. The initial position of the sucker rod string 126 can be adopted as a calculating benchmark. When raising or lowering the sucker rod string 126, the value of the initial position adds or decreases the distance of each adjustment, and the position of the sucker rod string 126 in the adjustment can then be obtained. The logging can further include information about the last surface and/or downhole diagnostic cards.

In an embodiment, the automatic control system 200 operates according to a method that includes interfacing with the surface pumping unit 101 (i.e., interfacing with existing pump-off controller 130*a* to shut down the unit 101 when the well has pumped off or interfacing with the variable frequency drive 140 of the variable drive controller 130*b* to vary the speed of the motor 102). This saves energy and prevents damage to the pumping unit 101 or improves its operation. There are various methods for detecting pump-off or for determining the need to change the pumping unit's speed.

For example, the surface card or downhole card can be used to detect pump-off or the need for speed change. The surface card can be obtained by measuring the load on the rod string 126, measuring the displacement of the rod sting 126 in a manner correlated with the measurement of the load on the rod 126 and integrating measured load versus displacement to obtain a total power input to the well. The actual load on the rod string 126 can be measured by a load cell (212) while the displacement of the rod string 126 can be measured by a beam angle transducer or other position sensor (214). When the total power falls below a predetermined minimum, it will be determined that the well has pumped-off.

Typically, there are no sensors to measure conditions at the downhole pump 150, which may be located thousands of feet underground. Instead, numerical methods are used to calculate the position of the pump plunger 152 and the load acting on the plunger 152 from measurements of the position and load for the rod string 126 at the surface so as to obtain a downhole card indirectly. The use of the downhole card eliminates errors caused by ambiguities in the surface card and obscuring effects of downhole friction along the rod string 126. The use of the downhole pump card, in addition, permits the control system 200 to detect additional malfunctions of the pumping unit 101 that are difficult to detect when surface cards are used.

In addition to providing for conventional starting and stopping of the pumping unit 101 to control the well, the automatic control system 200 for the device 10 can also control the well by varying the pumping speed. The pumping speed is varied in response to the change in a selected parameter of the surface card or downhole card. The parameter may be the area or portion of the area inside or outside of a downhole card or a surface card. Likewise, the parameter may be the change in the net liquid stroke of the pump 150.

In order to change the pumping speed, the pumping unit 101 is powered by the prime mover (e.g., electric motor) 102 equipped with the variable frequency drive (VFD) 140. The process of adjusting the pumping speed is thus not an on-off duty cycle process but rather a process that hunts for an optimum pump speed for continuous duty operation that maintains a selected target level. Thereafter, as conditions change, such as an increase or decrease in fluid entering the well W, the process will speed up the pump 101 or slow it down to match the condition to keep the desired fluid level target, which can be changed manually or remotely.

As noted herein, changing pumping conditions can affect the reciprocating rod lift system 100. For example, the change in load in the reciprocating rod lift system 100 due to the change in fluid level in the well W can significantly impact the overall weight that is applied to the rod string 126. As the fluid level is reduced due to production, for example, the load applied to the rod string 126 and the pumping unit 101 are increased. The effect of the increasing weight on the rod string 126 induces the lengthening (or increased length) of the components that make up the rod string 126. This change in length affects the distance between the valves 154, 158 in the pump 150. Therefore, the automated control system 200 can determine that the length change is detrimental to the reciprocating rod lift system 100 and can make the appropriate corrections to the depth of the plunger 152 automatically using the spacing device 10 without human interaction.

The control system 200 having the features of the variable drive controller 130*b* and the variable frequency drive (VFD) 140 operate to improve the efficiency of the well. Although a standard pump-off controller 130*a* controls the reciprocating rod lift system 100 by limiting the operation time, the control system 200 using the features of the variable drive controller 130*b* controls the speed at which production is made. For instance, the pump-off controller 130*a* determines the run time of the well by calculating the pump fillage and determining, by customer settings, when the unit 101 should run and when it should shut off. For its part, the control system 200 using the features of the variable drive controller 130*b* speeds up and slows down the pumping unit's strokes per minute by monitoring the pump efficiency.

As the pump efficiency increases, the pumping unit 101 is sped up by a calculated amount by increasing the drive speed of the variable frequency drive 140. Likewise, as the pump efficiency decreases, the strokes per minute of the pumping unit 101 are decreased by a calculated amount by decreasing the drive speed of the variable frequency drive 140. In this way, the variable drive controller 130*b* controls the pumping unit 101 with increased and decreased production based on pump fillage to maximize production without turning the well on and off as often. The variable drive controller 130*b* may still shut off the pumping unit 101, but only when the pump efficiency is still not acceptable even at the slowest speed.

As can be seen, increasing the pumping speed of the pumping unit 101 tends to decrease the fluid level in the well, which in turn increases the length of the rod string 126 due to the decrease in buoyancy. As a result of the lengthening, the plunger 152 tends to move closer to the bottom of the barrel 156, increasing the chances of tagging or pounding to occur. As can also be seen, decreasing the pumping speed of the pumping unit 101 tends to increase the fluid level in the well, which in turn decreases the length of the rod string 126 due to the increased buoyancy. As a result of the shortening, the plunger 152 may tend to move closer to the top of the barrel 156, reducing pump fillage.

In particular, the changing fluid levels in the well increases and decreases the load on the reciprocating rod lift pumping system 100 and especially the rod string 126. This change effects the length of the rod string 126 due to applied loading no matter if the length change is due to changing fluid levels or changing speeds. The effect of reducing fluid level increases the load on the system 100 due to the reduction of the buoyant effect of the fluid in the annulus. The increase and decrease of fluid in the system 100 continually effects the overall length of the rod string 126 and ultimately effects the spacing within the pump 150.

The same effects are applied to the pumping system 100 through changing fluid levels as through changing the speeds of the pumping unit 101 when operating with the variable frequency drive 140. As the pumping unit 101 increases in speed, a higher load is applied to the system 100, while effecting the fluid level (load on the system 100) more dramatically. When the pumping unit 101 is decreased in speed, the applied load is reduced to the pumping system 100. The changes to the loading of the rod string 126 ultimately effects the position of the plunger 152 in the barrel 156 and the spacing of the valves 154, 158 in the downhole pump 150.

The automated control system 200 using the features of the variable drive controller 130*b* and the variable frequency drive 140 continually monitors the conditions of the downhole pump 150 and automatically adjusts the plunger position (valving) using both speed adjustments of the variable frequency drive 140 in conjunction with spacing adjustments of the rod spacing device 10. This coordination can improve the efficiency of the pump 150 and can promote a longer life in the rod string 126, pump 150, and tubing by reducing or eliminating tagging or pounding of the pump 150.

Thus, in one configuration, the control system 200 (e.g., control unit 220) using the variable frequency drive 140 operable to set a speed to drive the reciprocation of the surface pumping unit 101 is configured to operate in a proactive manner. The control unit 220 calculates and sets the speed for the reciprocation of the pumping system 100 in conjunction with determining and making the adjustment for the depth of the plunger 152 in the barrel 156.

To set the speed for the reciprocation in conjunction with the determined adjustment for the depth, the control unit 220 correlates a first change in length of the rod string 126 (caused by a second change in the set speed of the reciprocation) to a third change in the depth for the plunger 152 in the barrel 156. The first change in length caused by the second change in speed can be predicted based on calculations, modeling, and empirical data. To determine the adjustment of the depth for the plunger 152 in the barrel 156 to be implemented by the spacing device 10, the control unit 220 is thereby configured to calculate the adjustment based on this correlation.

In another configuration, the control system 200 (e.g., control unit 220) using the variable frequency drive 140 operable to set a speed to drive the reciprocation of the surface pumping unit 101 is configured to operate in a reactive manner. The control unit 220 obtains the speed for the pumping unit 101 that has been set for the variable frequency drive 140. This set speed can be implemented independently by features of the variable drive controller 130*b* and can be based on any number of considerations. In turn, the control unit 220 is configured to determine the adjustment of the depth for the plunger 152 in the barrel 156 based at least on that set speed.

Again, to determine the adjustment of the depth for the plunger 152 in the barrel 156 based at least on the set speed, the control unit 220 can correlate a first change in length of the rod string 126 (caused by a second change in the speed of the reciprocation) to a third change in the depth for the plunger 152 in the barrel 156. The first change in length caused by the second change in speed can be predicted based on calculations, modeling, and empirical data. Based on the correlation, the control unit 220 can calculate the adjustment of the depth to be implemented by the spacing device in reaction to the set speed obtained during monitoring.

In either of these configurations, for example, the control unit 220 can raise the depth for the plunger 152 a first amount to counter an increase in length of the rod string 126 a second amount, which may have been caused by an increase in the pumping speed a third amount. Likewise, the control unit 220 can lower the depth for the plunger 152 a fourth amount to counter a decrease in length of the rod string 126 a fifth amount, which may have been caused by a decrease in the pump speed a sixth amount. As will be appreciated by one skilled in the art, the various amounts involved in these correlations will depend on the particular details of the implementation, including the depth of the well, the overall length of the sucker rod string, the taper of the rod string, numerical analysis of the string movement, the size of the downhole pump, the operating needs of the pumping unit, the fluid in the well, etc.

Although reference has been made above with respect to adjusting the depth of the plunger correlated to a change in the pumping speed, it will be appreciated that the correlation is not always direct and may depend on other variables. In fact, as disclosed herein, other variables, such as change in load, change in fluid level, etc., can be considered independently of (or in addition) to any correlation to the change in speed, and the effects from these other variables may necessitate adjustments by the control unit 220 and the spacing device 10. For example, incoming fluid can dynamically change the lifting load and can affect the pump efficiency, thereby requiring an adjustment in a manner similar to the changes in the pumping system disclosed herein.

In an embodiment, the automatic control system 200 operates according to a method that includes the drawing of surface and downhole cards and identification of common cards to identify possible issues. The downhole card can determine what is happening at the downhole pump 150 by interpretation of the shape of the downhole card.

Figure 3:
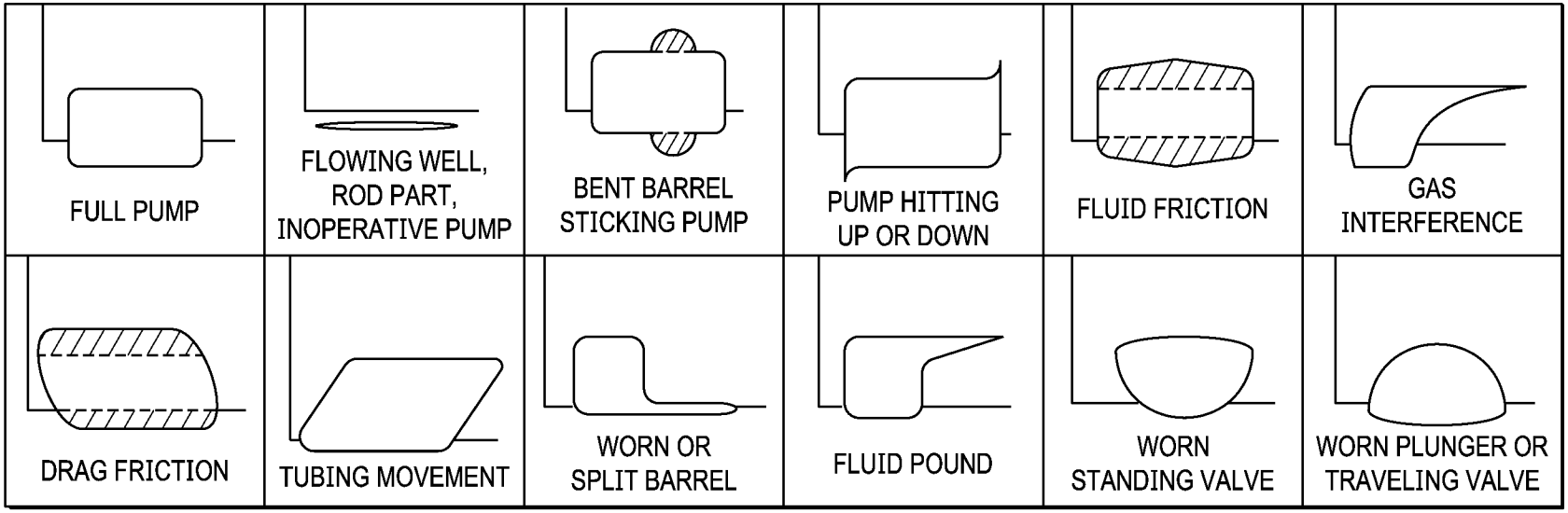
FIG. 3 is a view of shapes for a downhole card under different operating conditions.
Figure 4A:
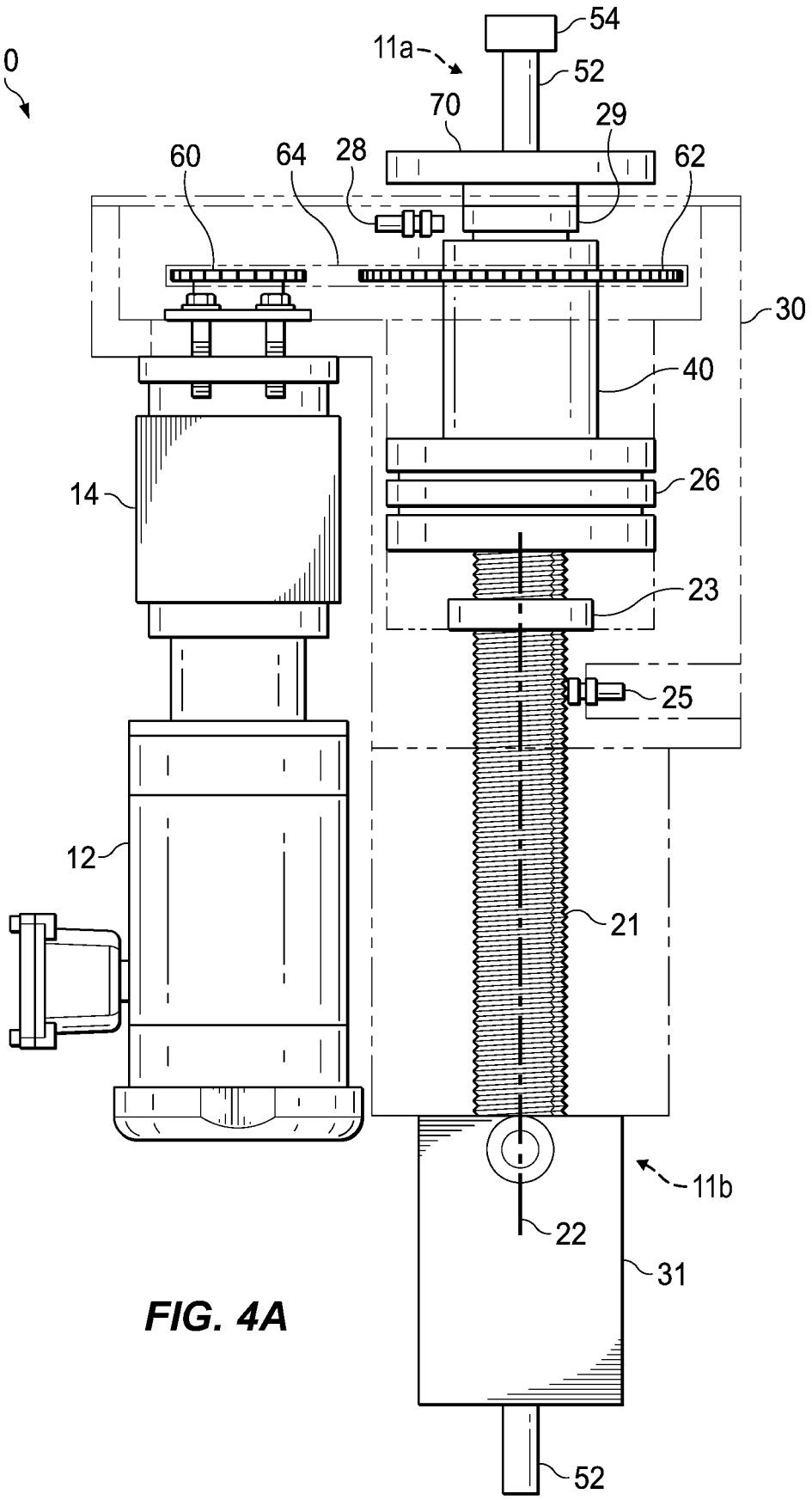
FIG. 4A is a front perspective view of an automated sucker rod spacing device of the present disclosure.
Figure 4B:
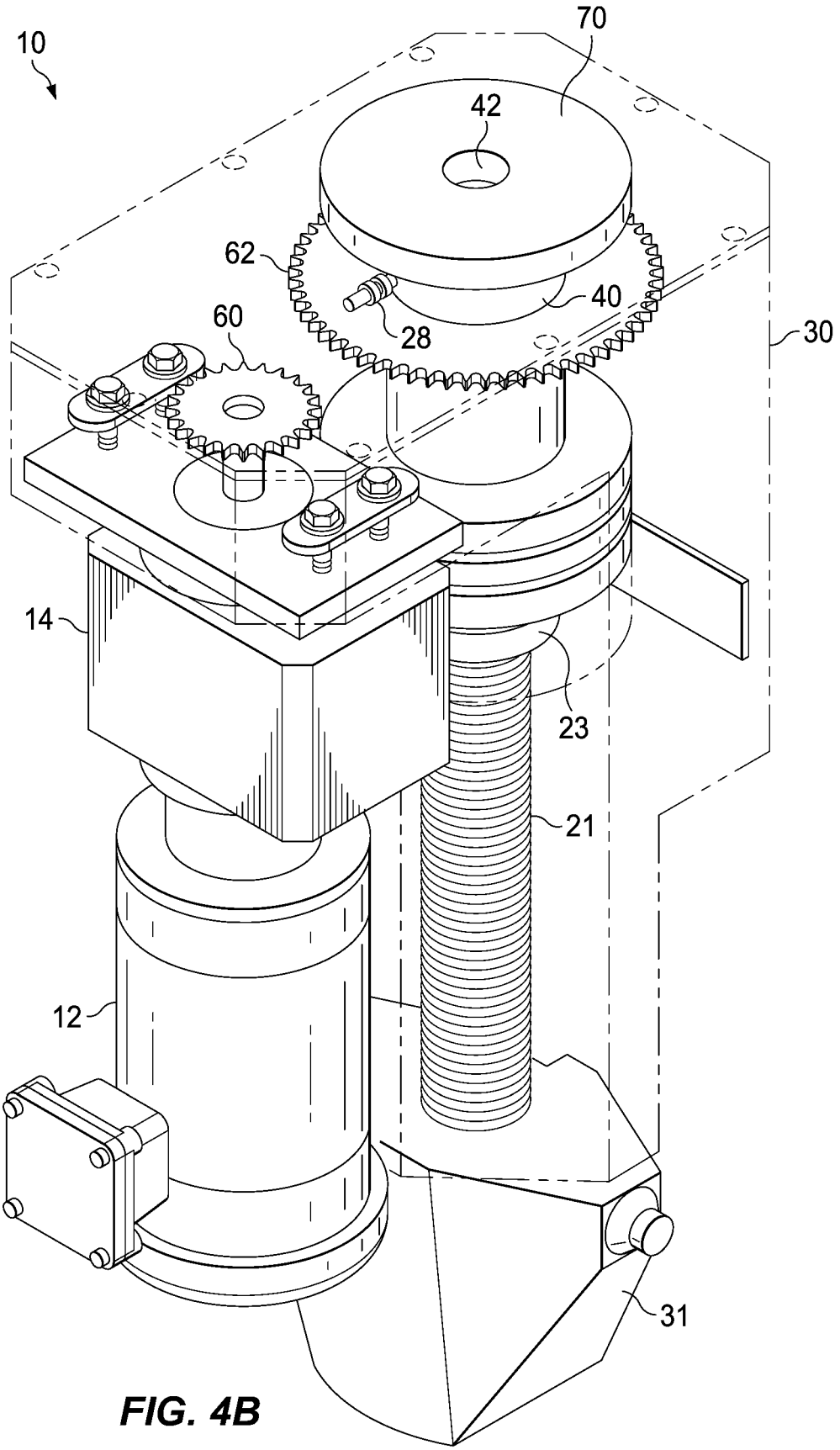
FIG. 4B is a left side perspective view of the device in FIG. 4A.
Figure 4C:
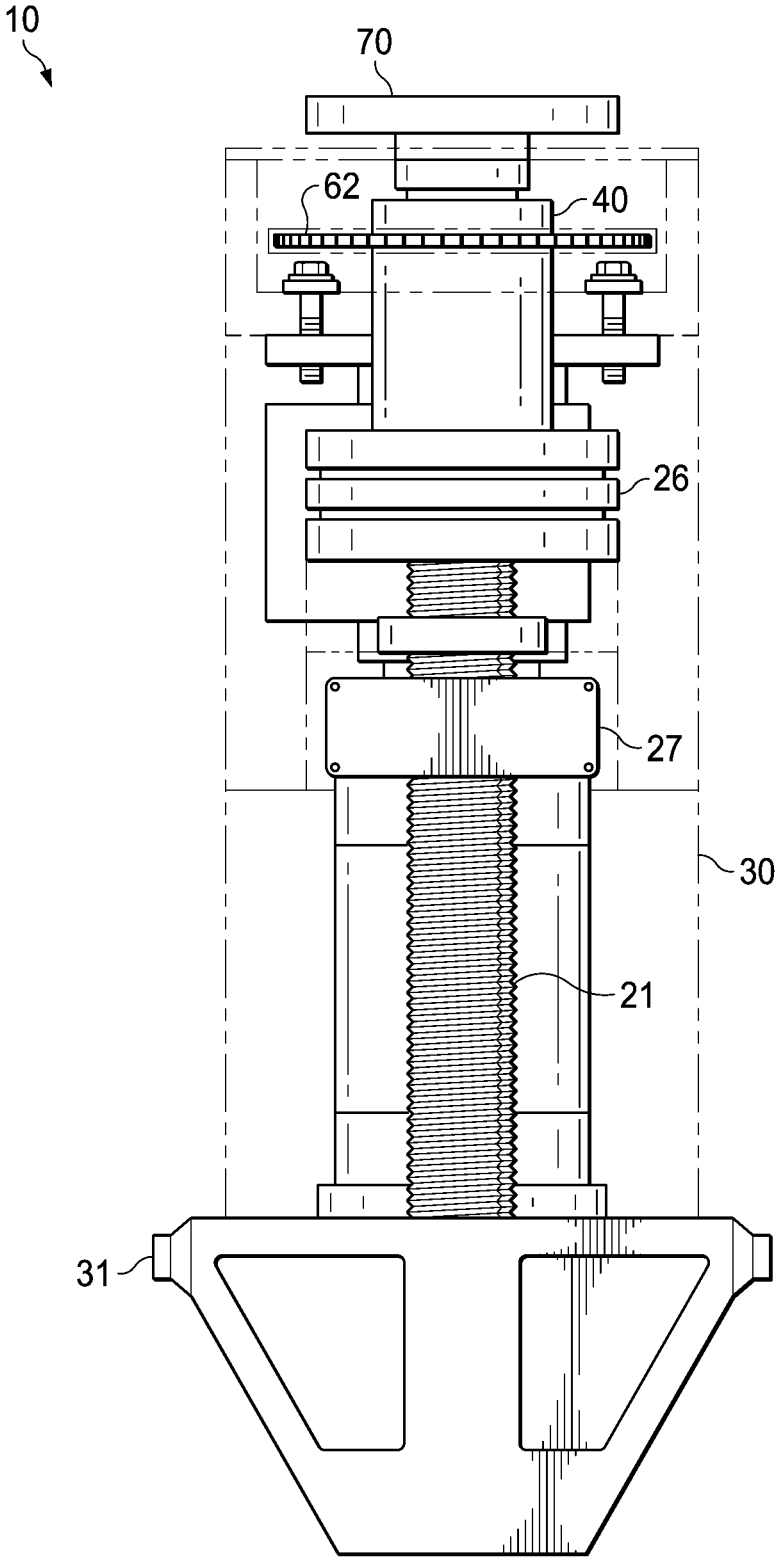
FIG. 4C is a right side perspective view of the device in FIG. 4A.
Figure 4D:
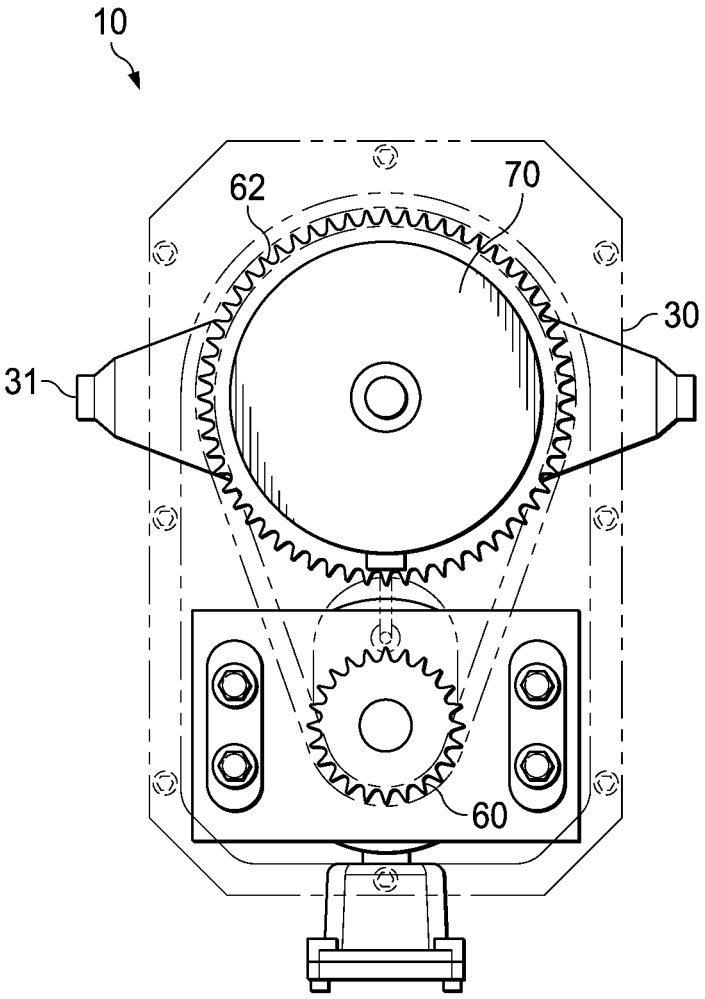
FIG. 4D is a top view of the device in FIG. 4A.

Referring to example downhole cards in FIG. 3, the possible issues include, but are not limited to, full pump (150); flowing well, rod part, inoperative pump (150); bent barrel (156) or sticking pump (150); pump plunger (152) hitting up and down; fluid friction; gas interference; drag friction; tubing movement; worn or split barrel (156), fluid pounding; worn standing valve (158); and worn plunger (152) or traveling valve (154).

In an embodiment, the control system (200) analyzes the shape of the card, identifies the issue, and adjusts the sucker rod string (126) with the spacing device (10) (and/or adjust the operation of the pumping unit 101—e.g., adjusts the variable frequency drive 140) in a manner to remedy the issue. If the unit (101) cannot correct the issue, a log and notification of possible identified issues can be produced.

In an embodiment of the device 10, the control system 200, and surface pumping unit 101 in FIGS. 1 and 2A-2B, for example, the control system 200 can shut down the surface pumping unit 101 if operating parameters are not met for programmable period of time. For example, a condition may arise where the pump 150 is not completely filled with fluid on each pump stroke or tagging cannot be adjusted (out of adjustment), which will waste energy or even damage the surface pumping unit 101.

In an embodiment, the automatic control system 200 operates according to a method that employs an artificial intelligence system (not shown) that can dynamically keep track of various parameters of the device 10, automatically adjust conditions, give early indications or warnings of failures, and provide suggestions on types of maintenance work required based on the knowledge acquired from previous best practices. Artificial intelligence techniques include, but are not limited to, the ability to learn from examples, fault tolerant managing of noisy and deficient data, tremendous potential for generating accurate analysis and results from a large historical database, use of the kind of data and individual or engineers may not consider valuable in conventional modelling and analysis processes.

In an embodiment, data is collected from the production well. In an embodiment, data can be collected from the control system 200. The control system 200 gathers and records periodic well sensor measurements measuring production and well status through load cells (212), pressure transducers (not shown), relays (not shown), and motor sensors (not shown). These sensors can record card area, peak surface load, minimum surface load, strokes per minute, surface stroke length, flow line pressure, pump fillage, yesterday cycles, and daily run time, these attributes can be sent over wireless network and recorded in a database.

In an embodiment, an accurate analysis can be generated based on the collected data utilizing including, but not limited to, artificial neural networks, fuzzy logic, expert systems, generic algorithms, support vector machines, functional network can be used. In an embodiment, "tagging" can be detected using artificial intelligence in the sucker rod spacing device 10.

In an embodiment, the methods disclosed herein can be implemented as instructions executed by a computer (e.g., control system 200 in FIGS. 1-2). Such computer-executable instructions may include programs, routines, objects, components, data structures, and computer software technologies that can be used to perform particular tasks and process abstract data types. Software implementations of the above described methods may be coded in different languages for application in a variety of computing platforms and environments.

In an embodiment, communication between any components of a sucker rod spacer system, such as user interface, well sensors, database, software, a processor and reporting unit, can be transferred over a communications network. A communications network can be any means that allows for information transfer. A communications network can also include any hardware technology used to connect the individual devices in the network, such as an optical cable or wireless radio frequency. In an embodiment, a communication system such as Bluetooth integration or SCADA compatible system, and/or monitoring of equipment (logs, reports, notification) from a remote location can be realized.

In an embodiment, the method can be integrated into a diagnostic software to export data and produce problem notification. The data can include but is not limited to a surface card, downhole card, entered sucker rod string, entered pump, strokes per minute, run time (24 hours, week, month), calculated production (24 hours, week, month) and variable frequency drive.

In an embodiment, the control system 200 and associated methods can determine pump efficiency. In an embodiment, the control system 200 and associated method can be utilized to determine if there is complete fillage of the pump 150. In an embodiment, the control system 200 and associated method can be utilized to determine if there has been displacement or slippage in the pump 150. In an embodiment, the control system 200 and associated methods can log data into reports. In an embodiment, reports can be produced indicating the occurrence of various adjustments performed by the sucker rod spacing device 10. In an embodiment, the number and type of adjustments performed by the sucker rod spacing device 10 are recorded. In an embodiment, the control system 200 determines whether to increase or decrease the sucker rod string 126. In an embodiment, the production calculations can be recorded and compared to the adjustments performed by sucker rod spacing device 10 to determine the effect on the adjustments on production.

In an embodiment, the control system 200 is aware of the current location and previous locations of the sucker rod spacing device 10. In an embodiment, the control system 200 logs the diagnostic cards. In an embodiment, the diagnostic cards include but are not limited to surface diagnostic cards and down hole diagnostic cards. In an embodiment, the control system 200 interfaces with the pumping unit 101 and/or the controller 130 to shut down the well when there is insufficient fluid to pump or a problem with all or a portion of a rod 126.

In an embodiment, there is a user interface to enter information regarding the production rod string and pump for the purpose of calculating the approximate production through a said time period (e.g., 24 hours, 1 week, 1 month).

In an embodiment, the control system 200 can shut down the unit 101 if the operating parameters are not met for the extent of a pre-programmed period of time. In an embodiment, the operating parameters can include but are not limited to problems with pump fillage and tagging that cannot be adjusted (out of adjustment).

In an embodiment, the sucker rod spacing device 10, sucker rod string 126, and the pumping unit 101 can be monitored from a remote location. In an embodiment, the logs, reports, and notifications can be accessed and reviewed from a remote location.

In an embodiment, the sucker rod spacing device 10 and sensors (not shown) are Bluetooth integrated. In an embodiment, the sucker rod spacing device 10 and sensors are SCADA compatible.

In an embodiment, the data from the sensors allows the production of a surface card and a downhole card. In an embodiment, the control system 200 is capable of identify common cards in order to identify the cause of an issue with the well.

In an embodiment, the control system 200 is able to notify a party if there is a problem with the well.

The automated control system 200 monitors the position of the plunger 152 of the downhole pump 150 and makes automatic adjustments to ensure complete pump fillage without tagging. In an embodiment, the position of the plunger 152 is constantly monitored.

In an embodiment, a portion of the rod spacing device 10 is a replacement of a current universal carrier bar on the pumping unit 101. For example, the device 10 can have two long screws that attach to the bridle on the horse's head 110 and can lower and/or retract the entire assembly in order to adjust the spacing of the sucker rod string 126 manually or with a motor 12 controlled by software or relays. Using the electrical motor 12 (or another type of motion device), a central shaft turns via a gearbox fed directly to the screw gears on the bottom of the device 10 via chains, timing belts, or other connecting materials, in order to turn the screws in synchronization to move the device 10 in a level position. Using load cells, strain gauges, accelerometers, and other such devices (210; FIG. 2), data is fed to the automated control system 200 that does real-time modeling of what is happening with the sucker rod string 126 downhole.

As is known, the load cell (212) is a transducer that creates an electrical signal whose magnitude is proportional to the force being measured. As the force measured with the load cell (212) increases, for example, the automated control system 200 can trigger the motorized device 10 to raise the sucker rod string 126.

The strain gauge (216) can measure the strain on the sucker rod string 126. If there is increased strain on the sucker rod string 126 measured by the strain gauge (216), the automated control system 200 can trigger the motorized device 10 to lower the sucker rod string 126.

As is known, the accelerometer (218) is an electromechanical instrument that measures the acceleration of motion of a structure. The force caused by the change in motion compresses the piezoelectric material causing production of an electrical charge proportional to the charge exerted on the piezoelectric material. If there is increased force on the sucker rod string 126 measured by the accelerometer (218), the automated control system 200 can trigger the motorized device 10 to raise the sucker rod string (126).

Based on different events encountered, the automated control system 200 can trigger the motorized device 10 to shorten or lengthen (raise/lower) the overall string 126, whichever is required for optimal production. The automated control system 200 monitors the status of the rod string 126 in real-time and is capable of making multiple unattended adjustments within minutes.

The mechanical movement for the spacing device 10 can be performed using various methods, including but not limited to, equipment that spools or unspools the bridle to raise and lower the string, using a motor, using hydraulics, and using air rams. Discussion now turns to details of an automated sucker rod spacing device of the present disclosure.

Referring to FIGS. 4A-4D, an automated sucker rod spacing device 10 includes a housing 30 and a screw 21 which is set within the housing 30. Anchored in the housing 30, a nut 40 is in threaded engagement with the screw 21, such that, as the nut 40 rotates, the screw 21 can move upwardly or downwardly. A thrust ball bearing 26 is located below the nut 40, while a screw support bearing 23 is located on the lower end of the screw 21. The thrust ball bearing 26 serves to help rotation and to support the nut 40 while the screw support bearing 23 serves to keep the screw 21 aligned. The nut 40 is advantageously located near the top of the screw 21 in its retracted position to make use of the full length of the screw 21. Cover 27 is present near screw 21. Top fastener 28 and side fastener 25 are present in relation to the housing 30. A motor 12 is provided to supply a rotational force to nut 40. Beneficial results have been obtained through the use of a bidirectional electric motor. Any kinds of electric motors including an AC motor or DC motor can be used. In an embodiment, the motor 12 is a three-phase induction motor coupled with a motor controller (not shown). Accordingly, the first connection 11*a* of the device 10 comprises the screw 21 supporting the rod string (not shown) at a first point (e.g., clamp 54). The second connection 11*b* of the device 10 comprises a nut 40 threaded on the screw 21 and supported at a second point (e.g., carrier bar 31) by the surface pumping unit (not shown). The actuator (e.g., motor 12) is operable to rotate the nut 40 on the screw 21 to adjust the adjustable spacing between the first and second points (54, 31).

There are various means to transmit a rotation force of the motor 12 to the nut 40. In an illustrated embodiment, the motor 12 is coupled to a sprocket wheel 60 through a rotational reducer 14. The rotational reducer 14 is formed to reduce the rotational speed supplied by the motor 12 and deliver the reduced speed to the sprocket wheel 60. A sprocket wheel 62 is mounted upon the nut 40. A continuous chain 64 is disposed in meshing engagement with the sprocket wheels 60, 62. The chain 64 and the sprocket wheels 60, 62 are all in the same plane and are housed in the housing 30 to protect them from weather, dust, and the like.

There are various means that can be provided for coupling a polish rod 52 to the screw 21, such that the polish rod 52 is raised and lowered with the screw 21. The screw 21 is hollow with a central axial bore 22, a load support plate 70 is mounted atop the screw 21 and has a central axial hole 42. A load support plate base 29 is present below the load support plate 70. The polish rod 52 extends up through the bore 22 and the central axial hole of the load support plate 70 and is secured to the screw 21 by a clamp 54 positioned at the top of the load support plate 70. It will be appreciated that the screw 21 does not have to be hollow, the polish rod 52 can be attached to the lower end of the screw 21. One possible disadvantage of doing so would be the height required.

The housing 30 rest on the carrier bar 31, the polish rod 52 passes through the center hole of the carrier bar 31, to enter a well head (e.g., 120; FIG. 1) through a packing gland (of stuffing box 122; FIG. 1) and connects to a sucker rod string (126; FIG. 1) as is well known in the art.

The operation of the sucker rod spacing device 10 will now be described. Supplying power to the motor 12 and the motor 12 can rotate, the rotation force of the motor 12 is transferred to the nut 40 through the reducer 14, the sprocket wheel 60, the chain 64 and the sprocket wheel 62. Upon rotation of the nut 40 in a first direction, the screw 21 travels upward, rising the polish rod 52, upon rotation of the nut 40 in a second direction, the screw 21 travels downward, lowering the polish rod 52. The sucker rod string (126) is connected to the polish rod 52, therefore the sucker rod string (126) is raised or lowered with the polish rod 52.

Figure 5A:
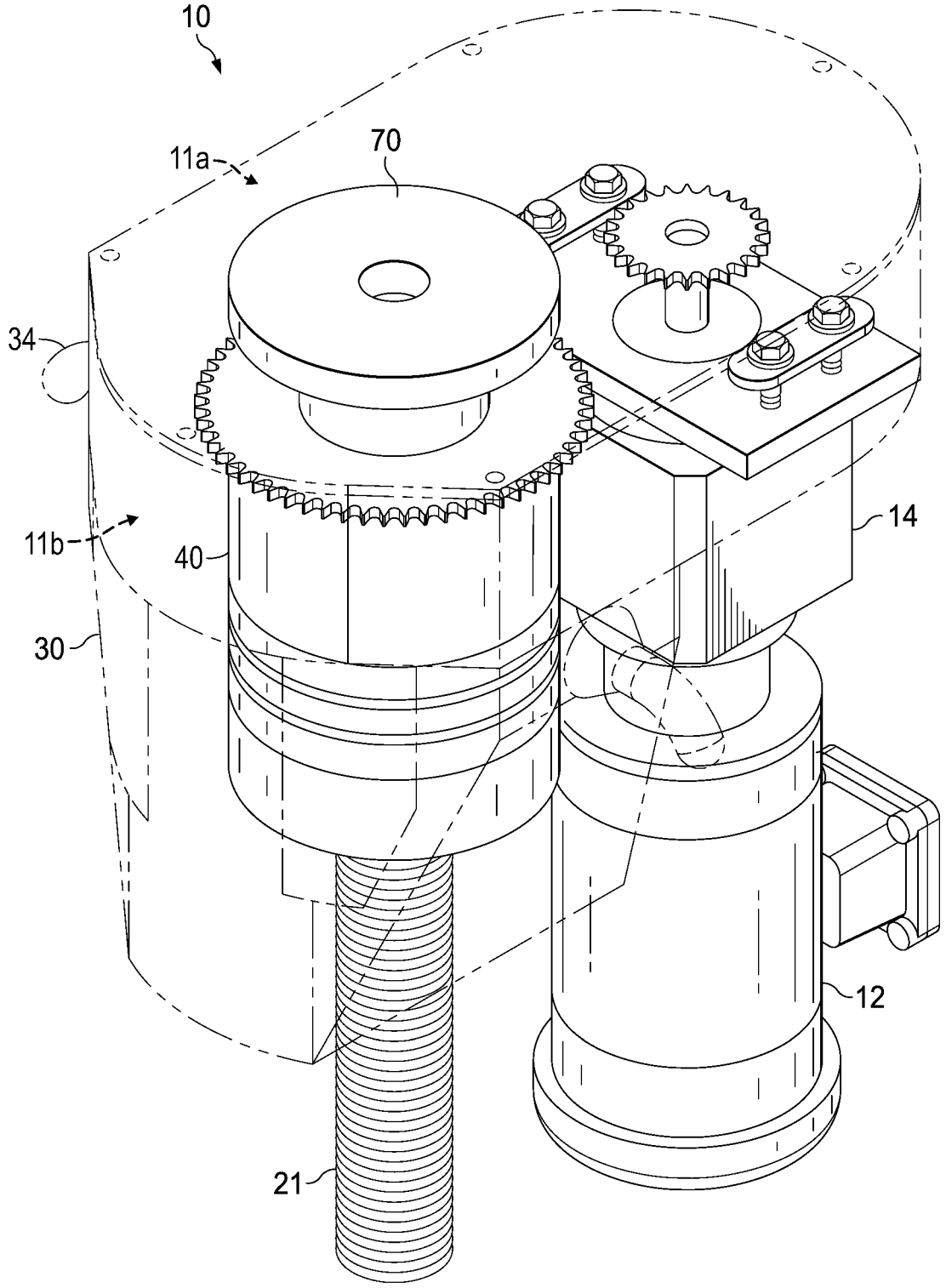
FIG. 5A is a front perspective view of another automated sucker rod spacing device of the present disclosure.
Figure 5B:
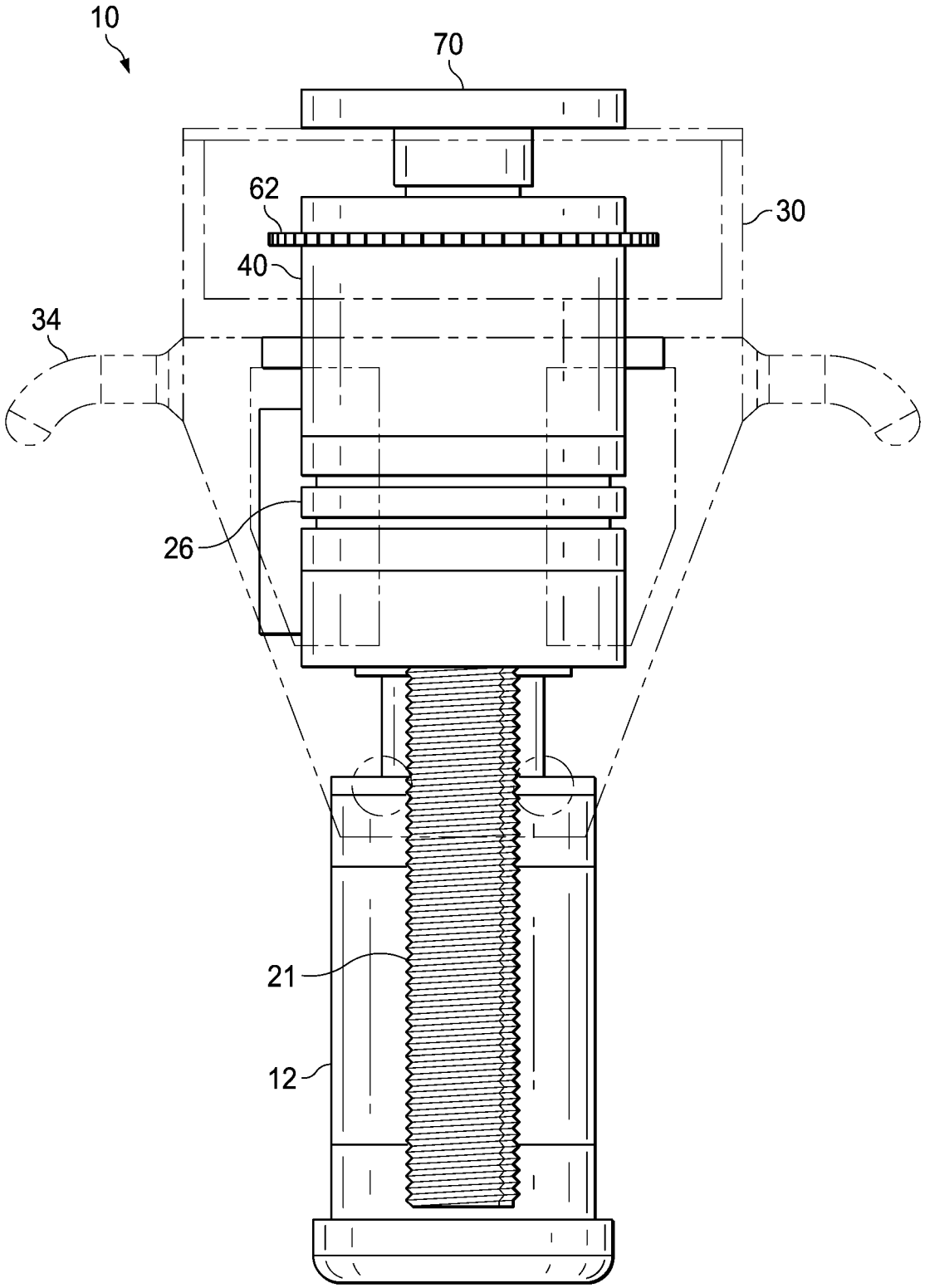
FIG. 5B is a left side perspective view of the device in FIG. 5A.
Figure 5C:
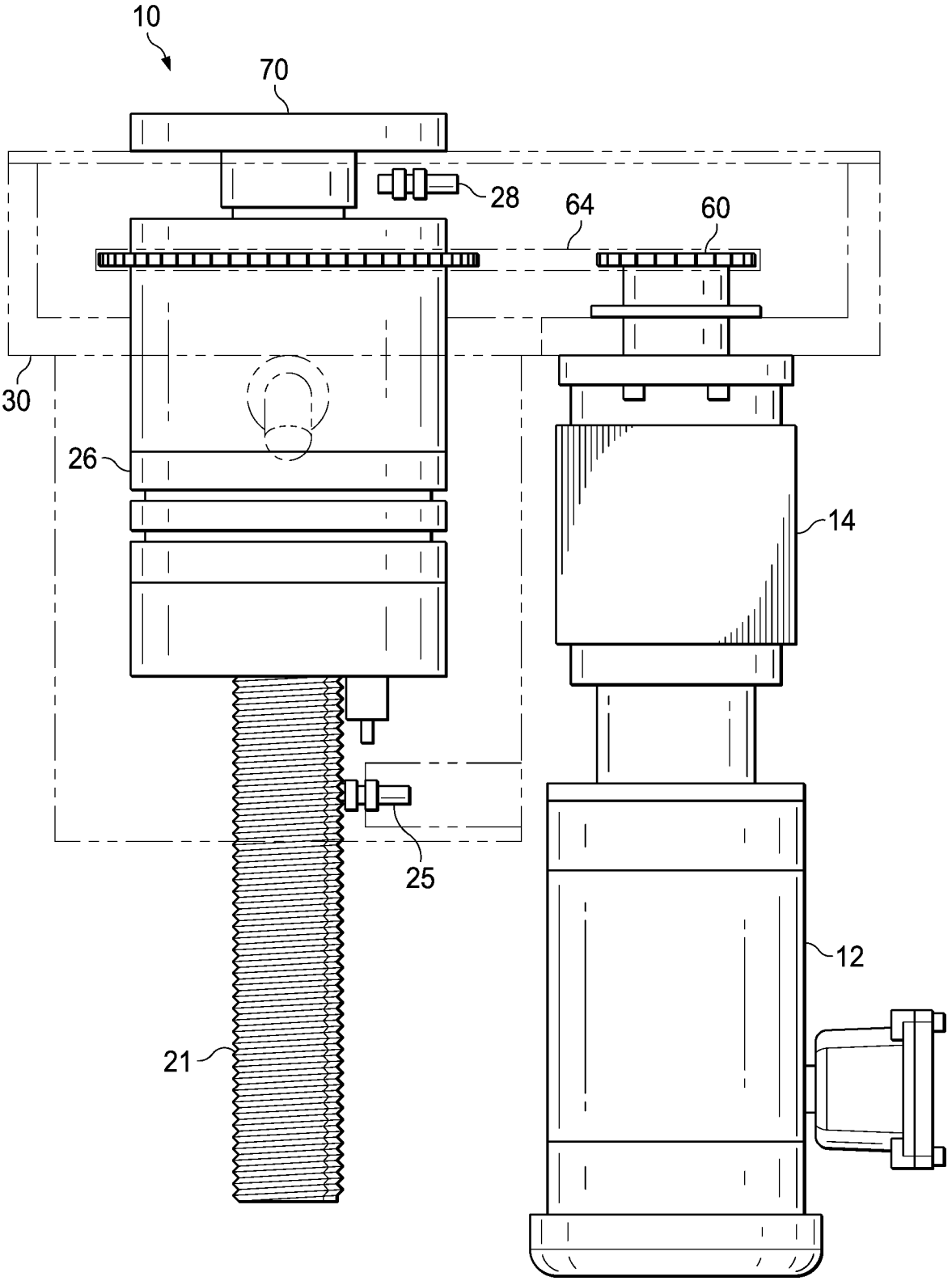
FIG. 5C is a right side perspective view of the device in FIG. 5A.
Figure 6A:
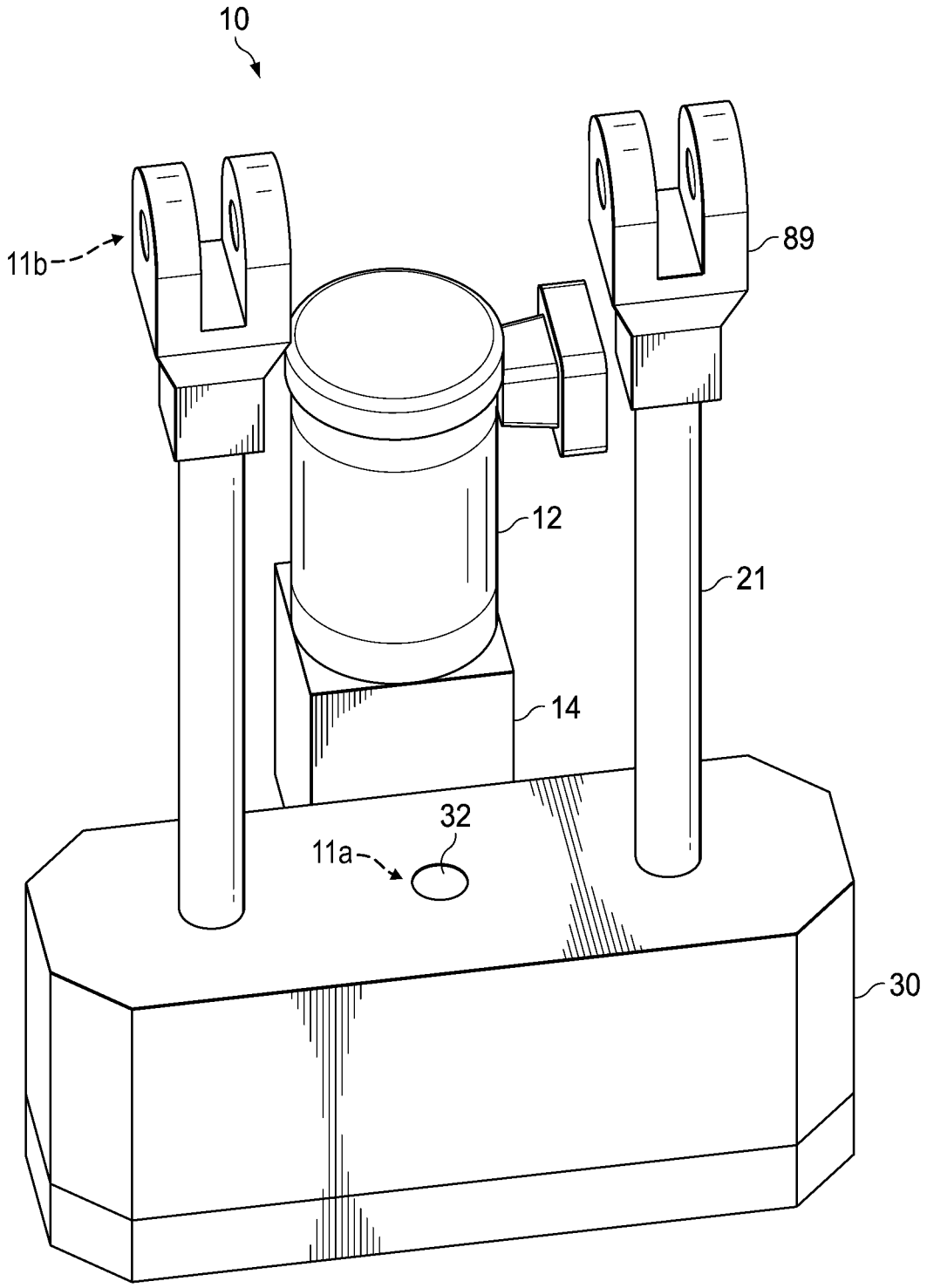
FIG. 6A is a front perspective view of yet another automated sucker rod spacing device of the present disclosure.
Figure 6B:
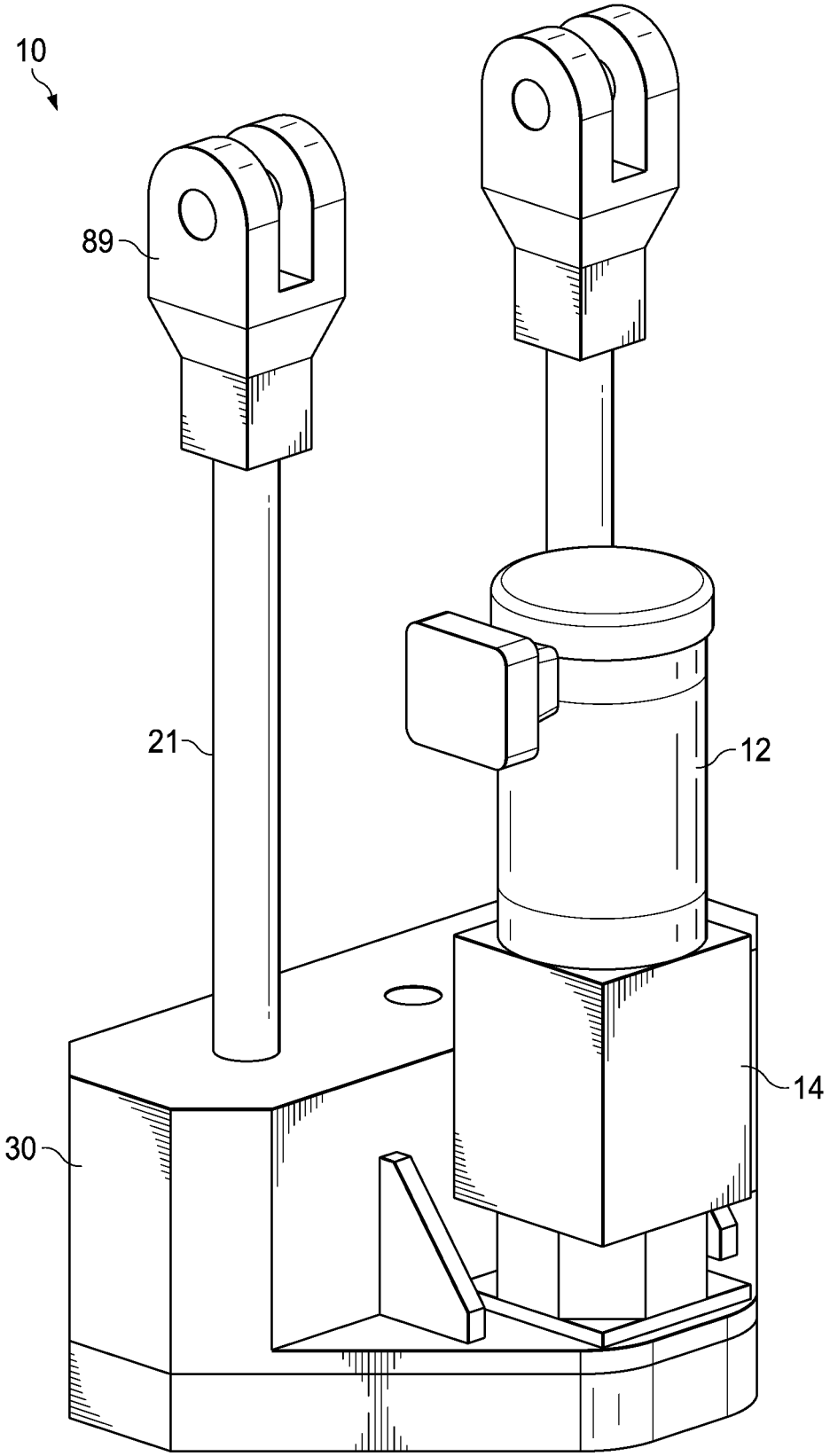
FIG. 6B is a rear perspective view of the device in FIG. 6A.
Figure 6C:
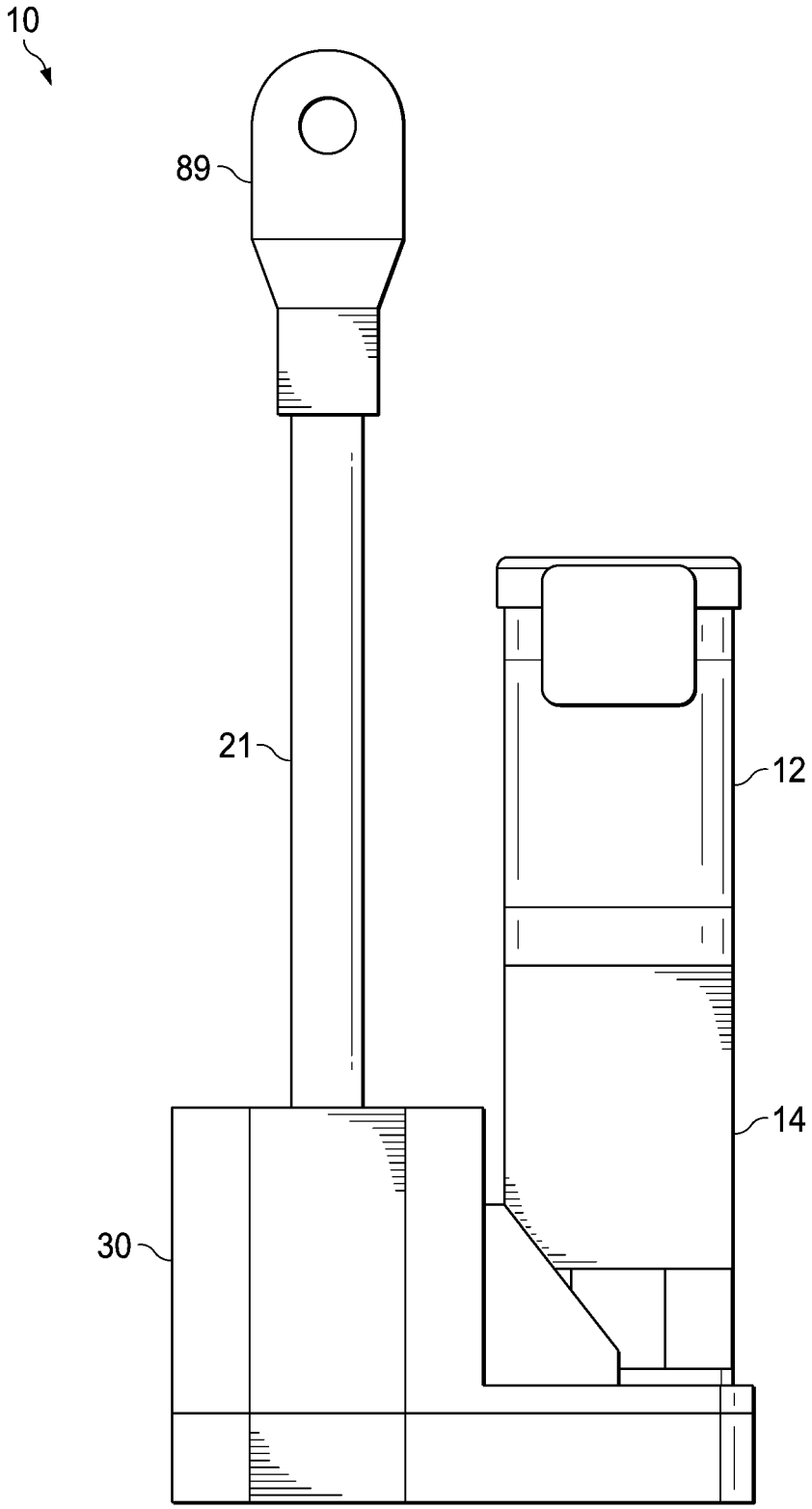
FIG. 6C is a side perspective view of the device in FIG. 6A.
Figure 6D:
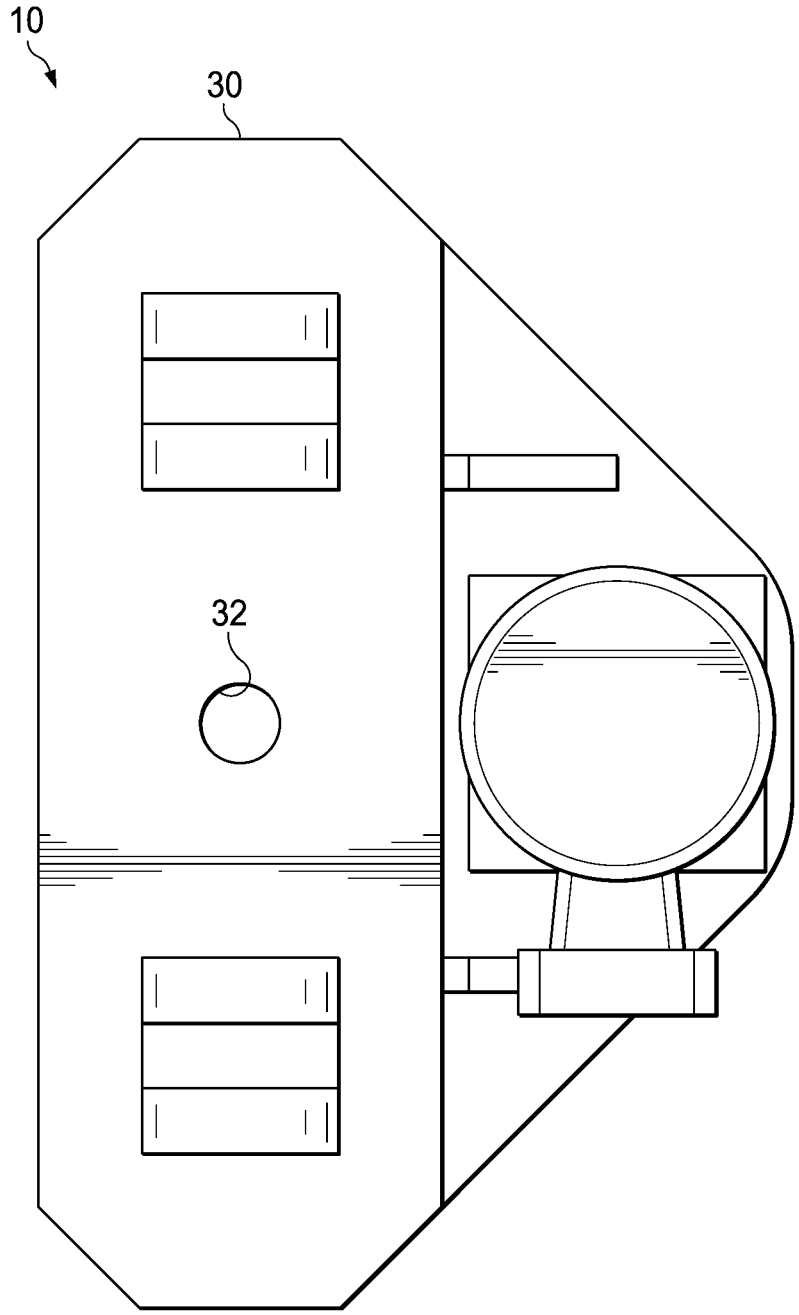
FIG. 6D is a bottom perspective view of the device in FIG. 6A.

In another embodiment, referring to FIGS. 5A-5B, the sucker rod spacing device 10 hooks directly into the carrier bar (not shown) and takes the place of the bridle (not shown). The unit 10 is constructed so that is fits within the current dimensional requirements of the carrier bar. The current carrier bar would be removed from the bridle assembly and the ear hooks 34 would fit into the bridle loops (not shown) just as said carrier bar was designed. The form, fit, and function of the bridle and the attachment of the new equipment will be functionally the same.

In FIGS. 5A-5B, an automated sucker rod spacing device 10 includes a housing 30 and a screw 21 which is set within the housing 30. Anchored in the housing 30, a nut 40 is in threaded engagement with the screw 21, such that, as the nut 40 rotates, the screw 21 can move upwardly or downwardly. A thrust ball bearing 26 is located below the nut 40. The thrust ball bearing 26 serves to help rotation and to support the nut 40. The nut 40 is advantageously located near the top of the screw 21 in its retracted position to make use of the full length of the screw 21. A motor 12 is provided to supply a rotational force to nut 40. Any kinds of electric motors including an AC motor or DC motor can be used. In an embodiment, the motor 12 is a three-phase induction motor coupled with a motor controller (not shown). Accordingly, the first connection 11*a* of the device 10 comprises the screw 21 supporting the rod string (not shown) at a first point (e.g., load support plate 70). The second connection 11*b* of the device 10 comprises a nut 40 threaded on the screw 21 and supported at a second point (e.g., ear hooks 34) by the surface pumping unit (not shown). The actuator (e.g., motor 12) is operable to rotate the nut 40 on the screw 21 to adjust the adjustable spacing between the first and second points (70, 34).

There are various means to transmit a rotation force of the motor 12 to the nut 40. In an illustrated embodiment, the motor 12 is coupled to a sprocket wheel 60 through a rotational reducer 14. The rotational reducer 14 is formed to reduce the rotational speed supplied by the motor 12 and deliver the reduced speed to the sprocket wheel 60. A sprocket wheel 62 is mounted upon the nut 40. A continuous chain 64 is disposed in meshing engagement with the sprocket wheels 60, 62. The chain 64 and the sprocket wheels 60, 62 are all in the same plane and are housed in the housing 30 to protect them from weather, dust, and the like.

The operation of the sucker rod spacing device 10 will now be described. Supplying power to the motor 12 and the motor 12 can rotate, the rotation force of the motor 12 is transferred to the nut 40 through the reducer 14, the sprocket wheel 60, the chain 64 and the sprocket wheel 62. Upon rotation of the nut 40 in a first direction, the screw 21 travels upward, rising the polish rod 52, upon rotation of the nut 40 in a second direction, the screw 21 travels downward, lowering the polish rod 52. The sucker rod string (126) is connected to the polish rod 52, therefore the sucker rod string (126) is raised or lowered with the polish rod 52.

In yet another embodiment, the sucker rod spacing device 10 can be a replacement of the current universal carrier bar (not shown). Referring to FIGS. 6A-6D, the sucker rod spacing device 10 comprises two screws 21 with ears 89 that will attach to the bridle on the horse's head. As previously described, the screws 21 engage threadedly with nuts, using an electrical motor 12 and a reducer 14, the rotation force of the motor 12 can be transmitted to the nuts via chains, timing belts, or other connecting materials (not shown) in the house 30, a polish rod (not shown) passes through a central hole 32 of the housing 30 and is secured to the sucker rod spacing device 10 by a clamp positioned at the top of the housing 30. Upon rotation of the nut, the screws 21 can be raised or lowered, such that the sucker rod string (126) is raised or lowered with the polish rod 52. Accordingly, the first connection 11*a* of the device 10 comprises a carrier (e.g., housing 30) supporting the rod string (nots shown) at a first point (hole 32). The second connection 11*b* of the device 10 comprises one or more screws 21 extending from the carrier 30 and supported at a second point (e.g., ears 89) by the surface pumping unit (not shown). The actuator (e.g., motor 12) is operable to adjust a length of the one or more screws 21 extending from the carrier 30 to adjust the adjustable spacing between the first and second points (32, 89).

It should be noted that the motor 12 used here is only exemplary and other means capable of increasing and decreasing the height of the sucker rod string such as hydraulic motor, air cylinders, and manual spacing can be employed.

All of the compositions and methods disclosed and claimed herein can be made and executed without undue experimentation in light of the present disclosure. While the compositions and methods of this disclosure have been described in terms of preferred embodiments, it will be apparent to those of skill in the art that variations may be applied to the compositions and methods and in the steps or in the sequence of steps of the methods described herein without departing from the concept, spirit and scope of the disclosure. More specifically, it will be apparent that certain agents which are both chemically related may be substituted for the agents described herein while the same or similar results would be achieved. All such similar substitutes and modifications apparent to those skilled in the art are deemed to be within the spirit, scope and concept of the disclosure as defined by the appended claims.

What is claimed is:

1. A system for a surface pumping unit being operable to reciprocate a rod string in a well, the rod string connected to a plunger of a downhole pump, the plunger disposed in a barrel of the downhole pump, the system comprising:

a control unit being configured to monitor reciprocation of the surface pumping unit and being configured to determine an adjustment of a depth for the plunger in the barrel based on the monitored reciprocation;

a device having a first connection to the rod string and having a second connection to the surface pumping unit, the device having an adjustable spacing between the first and second connections; and an actuator in communication with the control unit and being configured to adjust the adjustable spacing between the first and second connections of the device in response to the determined adjustment.

2. The system of claim 1, wherein the control unit is integrated with, is part of, is in communication with, is connected to, or comprises a controller being configured to control the reciprocation of the surface pumping unit.

3. The system of claim 1, further comprising a variable speed drive being operable to set a speed to drive the reciprocation of the surface pumping unit.

4. The system of claim 3, wherein the control unit is configured to set the speed for the reciprocation in conjunction with the determined adjustment for the depth of the plunger in the barrel.

5. The system of claim 4, wherein to set the speed for the reciprocation in conjunction with the determined adjustment for the depth, the control unit is configured to correlate a first change in length of the rod string caused by a second change in the speed of the reciprocation to a third change in the depth for the plunger in the barrel; and wherein to determine the adjustment of the depth for the plunger in the barrel, the control unit is configured to calculate the adjustment based on the correlation.

6. The system of claim 4, wherein the control unit is configured to raise the depth for the plunger a first amount to counter an increase in rod length a second amount due to an increase in the speed a third amount; and wherein the control unit is configured to lower the depth for the plunger a fourth amount to counter a decrease in rod length a fifth amount due to a decrease in the speed a sixth amount.

7. The system of claim 3, wherein the control unit obtains the set speed for the variable speed drive and is configured to determine the adjustment of the depth for the plunger in the barrel based at least on the set speed.

8. The system of claim 7, wherein to determine the adjustment of the depth for the plunger in the barrel based at least on the set speed, the control unit is configured to correlate a first change in length of the rod string caused by a second change in the speed of the reciprocation to a third change in the depth for the plunger in the barrel; and wherein to determine the adjustment of the depth for the plunger in the barrel, the control unit is configured to calculate the adjustment based on the correlation.

9. The system of claim 7, wherein the control unit is configured to raise the depth for the plunger a first amount to counter an increase in rod length a second amount due to an increase in the speed a third amount; and wherein the control unit is configured to lower the depth for the plunger a fourth amount to counter a decrease in rod length a fifth amount due to a decrease in the speed a sixth amount.

10. The system of claim 1, further comprising sensing equipment measuring at least one parameter in relation to the reciprocation of the rod string, wherein the control unit is configured to determine the adjustment of the depth for the plunger in the barrel based on the at least one measured parameter.

11. The system of claim 10, wherein the sensing equipment is configured to measure position and load at the surface pumping unit; and wherein to monitor the reciprocation, the control unit is configured to calculate fillage of the downhole pump from data of the measured position and load and is configured to determine the adjustment based on the calculated fillage.

12. The system of claim 10, wherein the sensing equipment comprise an accelerometer measuring acceleration as the at least one parameter in relation to the reciprocation of the rod string; and wherein to determine the adjustment of the depth for the plunger in the barrel based on the measured acceleration, the control unit is configured to:

detect a sudden change in the measured acceleration associated with tagging of the downhole pump; and actuate the actuator to decrease the adjustable spacing of the device, whereby the depth of the plunger is raised.

13. The system of claim 10, wherein the sensing equipment comprises an accelerometer measuring acceleration as the parameter in relation to the reciprocation of the rod string; and wherein to determine the adjustment of the depth for the plunger in the barrel based on the measured parameter, the control unit is configured to:

periodically lower the depth of the plunger until a sudden change in the measured acceleration associated with tagging of the downhole pump is detected; and subsequently actuate the actuator to decrease the adjustable spacing of the device an extent, whereby the depth of the plunger is raised.

14. The system of claim 1, wherein the first connection of the device comprises a screw supporting the rod string at a first point; wherein the second connection of the device comprises a nut threaded on the screw and supported at a second point by the surface pumping unit; and wherein the actuator is operable to rotate the nut on the screw to adjust the adjustable spacing between the first and second points.

15. The system of claim 1, wherein the first connection of the device comprises a carrier supporting the rod string at a first point; wherein the second connection of the device comprises one or more screws extending from the carrier and supported at a second point by the surface pumping unit; and wherein the actuator is operable to adjust a length of the one or more screws extending from the carrier to adjust the adjustable spacing between the first and second points.

16. A surface pumping unit being operable to reciprocate a rod string in a well, the rod string connected to a plunger of a downhole pump, the plunger disposed in a barrel of the downhole pump, the surface pumping unit comprising:

sensing equipment disposed on the surface pumping unit and measuring reciprocation of the surface pumping unit;

a control unit in communication with the sensing equipment and being configured to monitor the reciprocation of the surface pumping unit, the control unit being configured to determine an adjustment of a depth for the plunger in the barrel based on the monitored reciprocation;

a device having a first connection to the rod string and having a second connection to the surface pumping unit, the device having an adjustable spacing between the first and second connections; and an actuator in communication with the control unit and being configured to adjust the adjustable spacing between the first and second connections of the device in response to the determined adjustment.

17. The surface pumping unit of claim 16, further comprising a variable speed drive operable to set a speed to drive the reciprocation of the surface pumping unit; wherein the control unit is configured to:

set the speed for the reciprocation in conjunction with the determined adjustment for the depth of the plunger in the barrel; and/or obtain the set speed for the variable speed drive and determine the adjustment of the depth for the plunger in the barrel based at least on the set speed.

18. A method of operating a surface pumping unit being operable to reciprocate a rod string in a well, the rod string connected to a plunger disposed in a barrel of a downhole pump, the method comprising:

connecting an adjustable spacing with a first connection to the rod string and a second connection to the surface pumping unit;

monitoring reciprocation of the rod string by the surface pumping unit;

determining an automatic adjustment of a depth for the plunger in the barrel based at least on the monitored reciprocation; and actuating the adjustable spacing between the first and second connections automatically in response to the determined adjustment.

19. The method of claim 18, wherein monitoring the reciprocation of the rod string by the surface pumping unit comprises obtaining speed information of a variable speed drive of the surface pumping unit in relation to the reciprocation of the rod string; and wherein determining the automatic adjustment of the depth for the plunger in the barrel is based at least in part on the obtained speed information.

20. The method of claim 18, wherein monitoring the reciprocation of the rod string by the surface pumping unit comprises setting a speed for the reciprocation of the rod string by a variable speed drive of the surface pumping unit; and wherein determining the automatic adjustment of the depth for the plunger in the barrel is based at least in part on the set speed.

21. The method of claim 18, further comprising measuring, with sensing equipment, at least one parameter in relation to the reciprocation of the rod string, wherein determining the automatic adjustment comprises determining the automatic adjustment based at least in part on the at least one measured parameter.

22. The method of claim 21, wherein measuring, with the sensing equipment, the at least one parameter in relation to the reciprocation of the rod string comprises: diagnosing operation of the downhole pump as a function of a downhole card by processing surface data of the surface pumping unit; and analyzing the diagnosed operation, whereby determining the adjustment to the depth of the plunger is based at least in part on the analysis.

23. The method of claim 21, wherein measuring, with the sensing equipment, the at least one parameter in relation to the reciprocation of the rod string comprises measuring, with an accelerometer of the sensing equipment, acceleration as the at least one parameter in relation to the reciprocation of the rod string.

24. The method of claim 23, wherein determining the adjustment and adjusting the adjustable spacing comprises:

detecting a change in the measured acceleration associated with tagging of the downhole pump; and decreasing the adjustable spacing, whereby the depth of the plunger is raised.

25. The method of claim 23, wherein determining the adjustment and actuating the adjustable spacing comprises:

periodically lowering the depth of the plunger until a tag is detected in the measured acceleration; and subsequently raising the depth of the plunger an extent.

26. The method of claim 18, wherein determining the adjustment and actuating the adjustable spacing comprises at least one of:

preventing tagging of the plunger against the barrel of the downhole pump;

periodically optimizing the depth of the plunger in the barrel; and dislodging gas bubbles in the downhole pump by periodically tagging the downhole pump.

* * * * *